US010720709B2

(12) United States Patent
Kildal et al.

(10) Patent No.: US 10,720,709 B2
(45) Date of Patent: Jul. 21, 2020

(54) SELF-GROUNDED SURFACE MOUNTABLE BOWTIE ANTENNA ARRANGEMENT, AN ANTENNA PETAL AND A FABRICATION METHOD

(71) Applicant: Gapwaves AB, Göteborg (SE)

(72) Inventors: Per-Simon Kildal, Pixbo (SE); Sadegh Mansouri Moghaddam, Göteborg (SE); Andrès Alayon Glazonov, Upplands Väsby (SE)

(73) Assignee: GAPWAVES AB, Gothenburg (SE)

( * ) Notice: Subject to any disclaimer, the term of this patent is extended or adjusted under 35 U.S.C. 154(b) by 0 days.

(21) Appl. No.: 15/777,047

(22) PCT Filed: Dec. 8, 2015

(86) PCT No.: PCT/SE2015/051315
§ 371 (c)(1),
(2) Date: May 17, 2018

(87) PCT Pub. No.: WO2017/086853
PCT Pub. Date: May 26, 2017

(65) Prior Publication Data

US 2018/0337461 A1 Nov. 22, 2018

(30) Foreign Application Priority Data

Nov. 17, 2015 (WO) ..... PCT/SE2015/051231

(51) Int. Cl.
*H01Q 21/00* (2006.01)
*H01Q 9/28* (2006.01)
(Continued)

(52) U.S. Cl.
CPC ..... *H01Q 9/26* (2013.01); *H01Q 1/246* (2013.01); *H01Q 1/48* (2013.01); *H01Q 9/28* (2013.01);
(Continued)

(58) Field of Classification Search
None
See application file for complete search history.

(56) References Cited

U.S. PATENT DOCUMENTS 6,590,541 B1 7/2003 Schultze
2005/0146480 A1 7/2005 Yazdandoost et al.
(Continued)

FOREIGN PATENT DOCUMENTS

EP 1 432 071 6/2004
EP 2884580 6/2015
(Continued)

OTHER PUBLICATIONS

Extended European Search Report issued in European Patent Application No. 15908899.6, dated May 20, 2019, pp. 1-11.
(Continued)

*Primary Examiner* — Trinh V Dinh
(74) *Attorney, Agent, or Firm* — Jeffrey S. Melcher; Melcher Patent Law PLLC

(57) ABSTRACT

A self-grounded bowtie antenna arrangement includes an antenna structure having a number of antenna petals. An antenna petal has an arm section tapering toward an end tip portion and is made of an electrically conductive material. End tip portions are arranged to approach a first side of a base portion and to connect to feeding ports. The base portion includes a conductive ground plane or a printed circuit board. Each antenna petal is made in one piece from a conductive sheet, such as metal, and is surface-mounted on either the front side or back side of the base portion. Antenna petals can be mounted by automatic placement and soldering ("pick-and-place") machines.

25 Claims, 15 Drawing Sheets

(51) Int. Cl.

| | |
|---|---|
| ***H01Q 9/26*** | (2006.01) |
| ***H01Q 21/06*** | (2006.01) |
| ***H01Q 21/26*** | (2006.01) |
| ***H01Q 1/24*** | (2006.01) |
| ***H01Q 21/24*** | (2006.01) |
| ***H01Q 1/48*** | (2006.01) |
| *H01Q 5/25* | (2015.01) |

(52) U.S. Cl.
CPC ..... *H01Q 21/06* (2013.01); *H01Q 21/062* (2013.01); *H01Q 21/24* (2013.01); *H01Q 21/26* (2013.01); *H01Q 5/25* (2015.01); *H01Q 21/0025* (2013.01); *H01Q 21/0087* (2013.01)

(56) References Cited

U.S. PATENT DOCUMENTS

| | | | |
|---|---|---|---|
| 2005/0200549 | A1 | 9/2005 | Thompson et al. |
| 2006/0018147 | A1 | 1/2006 | Kolar |
| 2008/0150833 | A1 | 6/2008 | Huang |
| 2015/0162665 | A1 | 6/2015 | Goryssenko |
| 2015/0349435 | A1 | 12/2015 | Xue et al. |

FOREIGN PATENT DOCUMENTS

| | | | |
|---|---|---|---|
| JP | 3041690 | U | 9/1997 |
| JP | 2011 030196 | | 2/2011 |
| JP | 2015-531577 | A | 11/2017 |
| SE | 535251 | C2 | 5/2012 |
| SE | 1001072 | A1 | 6/2012 |
| TW | 200828673 | | 12/1995 |
| WO | 014/062112 | | 4/2014 |
| WO | 2014/062112 | A1 | 4/2014 |
| WO | 2016/163932 | A1 | 10/2016 |

OTHER PUBLICATIONS

Y. Mushiake, Self-Complementary Antennas, IEEE Antennas & Propagation, Dec. 1992, pp. 23-29, vol. 34, No. 6.

H. Raza et al., Wideband Compact 4-Port Dual Polarized Self-Grounded Bowtie Antenna, IEEE Trans. Antennas & Propagation, Sep. 2014, pp. 1-7, vol. 62, No. 9.

P.-S. Kildal et al., Preparing for Gbitls Coverage in 5G: Massive MIMO, PMC Packaging by Gap Waveguides, OTA Testing in Random LOS, 2015 Loughborough Antennas & Propagation Conf., Nov. 2-3, 2015.

M.Z. Win et al., History and Applications of UWB, Proc. IEEE, Feb. 2009, pp. 198-204, vol. 97, No. 2.

Lestari et al., A Modified Bow-Tie Antenna for Improved Pulse Radiation, IEEE Trans. Antennas & Propagation, Jul. 2010, pp. 2184-2192, vol. 58, No. 7.

A.K. Amert et al., Miniaturization of the Biconical Antenna for Ultra-Wideband Applications, IEEE Trans. Antennas & Propagation, Dec. 2009, pp. 3728-2735, vol. 57, No. 12.

P.J. Gibson, The Vivaldi Aerial, Proc. 9th Euro. Microwave Conf., 1979, pp. 101-105.

Sweden Patent and Registration Office, Intl Search Report in PCT/2015/051315, dated Jul. 28, 2016.

Sweden Patent and Registration Office, Written Opinion in PCT/2015/051315, dated Jul. 28, 2016.

Office Action issued in corresponding Japanese Patent Application No. JP-211-6333, dated Aug. 20, 2019, pp. 1-15 (Translation).

Office Action issued in corresponding Chinese Patent Application No. 201580084645.0, dated Sep. 12, 2019, pp. 1-12, Translation pp. 1-15.

SELF-GROUNDED SURFACE MOUNTABLE BOWTIE ANTENNA ARRANGEMENT, AN ANTENNA PETAL AND A FABRICATION METHOD

TECHNICAL FIELD

The present invention relates to a self-grounded antenna arrangement having the features recited in the claims.

The present invention also relates to an antenna petal for a self-grounded antenna arrangement having the features recited in the claims.

The invention still further relates to a method for producing a self-grounded antenna arrangement having the features recited in the claims.

BACKGROUND

There is an increasing demand for wideband antennas for use within wireless communication, in order to allow communication in several frequency bands, the use of high or very high data rates and for different systems. Ultra Wide Band (UWB) signals are generally defined as signals having a large relative bandwidth (bandwidth divided by carrier frequency) or a large absolute bandwidth. The expression UWB is particularly used for the frequency band 3.2-10.6 GHz, but also for other and wider frequency bands.

The use of wideband signals is for example described in "History and applications of UWB", y M. Z. Win et. al, Proceedings of the IEEE, vol. 97, No. 2, p. 198-204, February 2009.

UWB-technology is a low cost technology. Development of CMOS processors transmitting and receiving UWB-signals has opened up for a large field of different applications and they can be fabricated at a very low cost for UWB-signals without requiring any hardware for mixers, RF (Radio Frequency)-oscillators or PLLs (Phase Locked Loops).

UWB technology can be implemented in a wide range of areas, for different applications, such as for example short range communication (less than 10 m) with very high data rates (up to or above 500 Mbps), e.g. for wireless USB similar communication between components in entertainment systems such as DVD players, TV and similar; in sensor networks where low data rate communication is combined with precise ranging and geolocation, and radar systems with extremely high spatial resolution and obstacle penetration capabilities, and generally for wireless communication devices.

To generate, transmit, receive and process UWB signals, the development of new techniques and arrangements within the fields of generation of signals, signal transmission, signal propagation, signal processing and system architectures is required.

Generally UWB antennas have been divided into four different categories of which the first category, the scaled category, comprises bowtie dipoles, see for example "A modified Bow-Tie antenna for improved pulse radiation", by Lestari et.al, IEEE Trans. Antennas Propag., Vol. 58, No. 7, pp. 2184-2192, July 2010, biconical dipoles as for example discussed in "Miniaturization of the biconical Antenna for ultra-wideband applications" by A. K. Amert et. al, IEEE Trans. Antennas Propag., Vol. 57, No. 12, pp. 3728-3735, December 2009. The second category comprises self-complementary structures as e.g. described in "Self-complementary antennas" by Y. Mushiake, IEEE Antennas Propag. Mag., vol. 34, No. 6, pp. 23-29, December 1992. The third category comprises travelling wave structure antennas, e.g. the Vivaldi antenna as e.g. discussed in "The Vivaldi aerial" by P. J. Gibson, Proc. $9^{th}$ European Microwave conference, pp. 101-105, 1979, and the fourth category comprises multiple resonance antennas like log-periodic dipole antenna arrays.

Antennas from the scaled category, the self-complementary category and the multiple reflection category comprise compact, low profile antennas with low gain, i.e. having wide and often more or less omni-directional far field patterns, whereas antennas of the travelling wave category, like the Vivaldi antennas, are directional.

The above-mentioned UWB antennas were mainly designed for use in normal Line-of-Sight (LOS) antenna systems with one port per polarization and a known direction of the single wave between the transmitting and receiving side of the communication system. In most environments, however, there are several objects (such as houses, trees, vehicles, humans) between the transmitting and receiving sides of the communication systems that cause reflections and scattering of the waves, resulting in a multiple of incoming waves on the receiving side, which has as a consequence that there was a need for antennas better accounting for these factors. Interference between these waves causes large level variations known as fading of the received voltage (known as the channel) at the port of the receiving antenna. This fading can be counteracted in modern digital communication systems making use of multiport antennas and support MIMO technology (multiple-input multiple-output).

Wireless communication systems may comprise a large number of micro base stations with multiband multiport antennas enabling MIMO with high requirements as to compactness, angular coverage, radiation efficiency and polarization schemes, which all are critical issues for the performance of such systems. The radiation efficiency of a multiport antenna is reduced by ohmic losses and impedance mismatch like in single-port antennas, but also by mutual coupling between the antenna ports.

Earlier known wideband antenna arrangements did not satisfactorily meet these requirements.

In WO2014/062112, though, a wideband compact multiport antenna suitable for MIMO communication systems as described above is disclosed, which has low ohmic losses, i.e. high radiation efficiency, good matching as well as low coupling between antenna ports. The geometry shown in FIG. 11 of WO2014/062112 is known as a dual-polarized self-grounded bowtie antenna, and is described in H. Raza, A. Hussain, J. Yang and P.-S. Kildal, "Wideband Compact 4-port Dual Polarized Self-grounded Bowtie Antenna", IEEE Transactions on Antennas and Propagation, Vol. 62, No., pp. 1-7, September 2014. The geometry of the self-grounded bowtie antenna is expensive to manufacture in large volumes, and in particular to mass produce.

For future wireless communication systems, such as e.g. the fifth wireless generation (5G), the frequencies used may be up to 30 GHz, or even up to 60 GHz, and Massive MIMO is a challenging option for providing a sufficient gain and steer-ability at millimeter wave frequencies, see "Preparing for GBit/s Coverage in 5G: Massive MIMO, PMC Packaging by Gap Waveguides, OTA Testing in Random LOS" by Per-Simon Kildal, 2015 Loughborough Antennas & Propagation Conference, 2 & 3 Nov. 2015.

Massive MIMO array antennas, or Large-scale Antenna Systems or Very Large MIMO arrays etc. are, contrarily to hitherto known antenna systems, based on the use of a large number of antenna elements, from a few tenths to hundreds or even thousands thereof, for being operated independently to adapt coherently to the incoming wave or waves in the environments in such a way that the signal-to-noise ratio is maximized. Massive MIMO is particularly advantageous in that data throughput and energy efficiency can be considerably increased e.g. when a large number of user stations are scheduled simultaneously, i.e. a multi-user scenario.

MIMO arrays and Massive MIMO Array antennas consist of several equal antenna elements side by side. This makes manufacture as well as and mounting extremely difficult, expensive and time consuming.

A massive MIMO array is the digital equivalent to a traditional phased array antenna. The phased array contains analogue controllable phase shifters on all elements in order to phase-steer the antenna beam to the direction needed. In MIMO technology there is an Analogue to Digital Converter (ADC) or a Digital to Analogue Converters (DAC) on each element, so that all beam-steering is done digitally, and no analogue phase shifters are needed. This makes the MIMO antenna system much more flexible and adaptive than phased-arrays, so that any beam shape and even multiple beams can be formed. This is referred to as digital beamforming.

All known antenna arrangements, even if meeting many of the functional requirements referred to above, suffer from the drawbacks of not being sufficiently easy and cheap to fabricate and not being as easy to mount as would be desired. This is a problem both for older and present generations of communication systems, and also for other implementations, but become even more pronounced for future communication systems, such as e.g. 5G, and also other future applications at higher frequencies than those used today. They also suffer from the drawback of not providing a sufficient bandwidth.

SUMMARY

It is therefore an object of the present invention to provide an antenna arrangement through which one or more of the above mentioned problems can be solved.

It is particularly an object of the invention to provide a self-grounded bowtie antenna arrangement, e.g. an UWB multiport antenna for a MIMO system, which is easy and cheap to fabricate. Still further it is an object of the invention to provide an antenna arrangement which is easy to mount, and an antenna arrangement that is small and compact. Another object is to provide an antenna arrangement allowing surface mounting, and in particular for surface mounting on a PCB using placement machines and soldering machines.

Even more particularly it is an object of the invention to provide an antenna arrangement, which is suitable for mass production. It is also one most particular object to provide an antenna arrangement, which is flexible and a concept that allows for fabrication of different antenna arrangements based on the same principles for many different applications.

A particular object is to provide an antenna arrangement that can be used for very high frequencies, e.g. up to 100 or even 150 GHz. Another most particular object is to provide an antenna arrangement suitable for Massive MIMO, and even more particularly for future 5G communication systems.

It is also a particular object of the invention provide an antenna arrangement that can be used in phased arrays and in MIMO arrays. Still further it is an object to provide an antenna arrangement providing a large or even very large bandwidth.

It is also an object to provide an antenna arrangement suitable for micro base stations for wireless communication, e.g. also enabling reduction of multipath fading effects.

Another object is to provide an antenna arrangement, most particularly an UWB multiport antenna, which is suitable for use in measurement systems for wireless devices with or without MIMO capability, such as measurement systems based on reverberation chambers, or for use in OTA (over The-Air) test systems in anechoic chambers for wireless communication to vehicles, e.g. cars.

Therefore an arrangement as initially referred to is provided which has the characterizing features recited in the claims.

Therefore also an antenna petal as initially referred to and having the features recited in the claims is provided.

Still further it is an object of the present invention to provide a method for fabrication of an antenna arrangement through which one or more of the above mentioned objects can be achieved. It is in particular an object to provide a method which is easy to carry out, which involves only low costs, which is reliable and repeatable, and which allows mass-production. It is further an object of the invention to provide a method for fabrication of an antenna arrangement allowing surface mounting.

Therefore a method as initially referred to is provided which has the characterizing features recited in the claims.

Advantageous embodiments are given by the respective appended dependent claims.

Particularly a multiport antenna is provided, which, in addition to being extremely easy and cheap to fabricate and mount, also enables a weak mutual coupling between the antenna ports, so that the far field functions become almost orthogonal. Particularly a multiport antenna arrangement with a weak mutual coupling between the antenna ports is provided which ensures that far field functions are orthogonal in some sense, such as in terms of polarization, direction or shape. With orthogonal is here meant that the inner products of the complex far field functions are low over the desired coverage of the antenna arrangement. Particularly, there is also provided an UWB antenna arrangement which, in addition to being extremely easy and cheap to fabricate and mount, also is suitable for measurement systems for wireless devices of wireless systems, with or without MIMO capability, most particularly for Massive MIMO, which has multiple ports, with a weak coupling, particularly no coupling at all, or at least a coupling which is as low as possible between them, and orthogonal far field functions.

The inventive concept is particularly advantageous for antenna arrangements for use in MIMO antenna systems for statistical multipath environments, most particularly for Massive MIMO antenna systems.

It is a an advantage of the invention that it facilitates manufacturing and assembly and enables a considerable reduction in manufacturing and assembly costs through the provisioning of elements, that can be mass-produced, with a shape that makes it possible to mount them side by side on a surface by an automatic machine. Such elements can be referred to Surface Mount Devices (SMD), if they are small enough to be mounted on a Printed Circuit Board (PCBs). The technology itself is called Surface Mount Technology (SMT), and the placement equipment used to mount SMDs on PCBs are commonly known as pick-and-place machines. The SMDs are normally fixed to the PCB by soldering in a wave soldering machine or a selective soldering machine following the pick-and-place machine. Thus, using SMT technology, can significantly reduce the manufacture cost of massive MIMO arrays, and in particular when they are used at high frequency.

An antenna arrangement containing two opposing halves is herein referred to as a bowtie, each half referred to as a petal. However, each half can also be used separately as a half-bowtie antenna element. More commonly two full bowtie antenna arrangements are mounted orthogonal to each other to form a dual-polarized bowtie arrangement as described in the references WO2014/062112 and H. Raza, A. Hussain, J. Yang and P.-S. Kildal, "Wideband Compact 4-port Dual Polarized Self-grounded Bowtie Antenna", IEEE Transactions on Antennas and Propagation, Vol. 62, No., pp. 1-7, September 2014 referred to above. A dual-polarized bowtie has therefore four petals of which each opposing pair can be differentially excited to form a dual polarized two-port antenna.

The antenna arrangement according to the invention can be used both in phased arrays and in MIMO arrays.

BRIEF DESCRIPTION OF THE DRAWINGS

The invention will in the following be further described in a non-limiting manner, and with reference to the accompanying drawings, in which.

DETAILED DESCRIPTION

Figure 1:
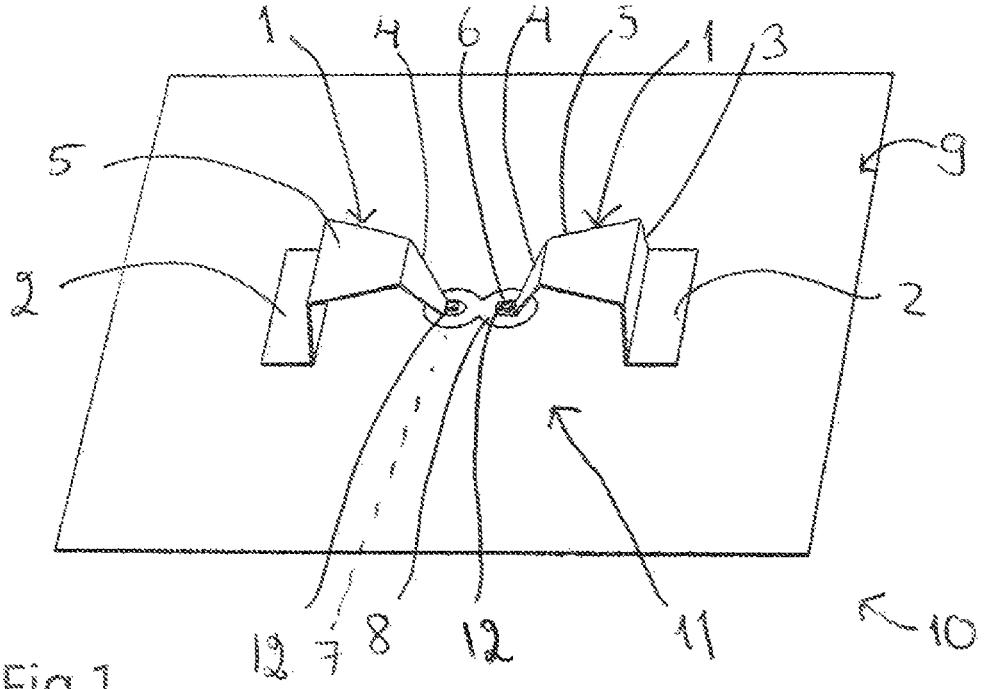
FIG. 1 is a view in perspective of an antenna arrangement according to a first embodiment of the present invention comprising two antenna petals, corresponding to a linearly-polarized bowtie antenna.

FIG. 1 shows a first embodiment of a bowtie antenna arrangement 10 according to the invention which comprises one bowtie structure 11 comprising two antenna petals 1,1 made of an electrically conducting material forming two arm sections which are so arranged that end tip portions 6,6 of the arm sections point substantially towards one another at a location e.g. at the center of a front, in FIG. 1 upper, side of a metal ground plane or a PCB (Printed Circuit Board) 9 for forming antenna ports. The end tip portions 6,6 are here provided with holes or openings 7,7 for soldering of conducting elements, e.g. conducting wires or pins 12,12 which are connected to coaxial or microstrip lines, or a circuit (not shown), located on the back (lower) side of the metal ground plane or the PCB 9.

The bowtie antenna arrangement 10 consists of two opposing halves, with are fed separately from two centrally located feed points. The two feed points can be used independently as two separate ports, but they can also be fed differentially as one port. In the latter case there is needed a so-called balun to make a transition from the two balanced feed points to the single-ended port. The latter is then normally a single coaxial cable or a microstrip line. The balun can also be realized as a separate circuit called a 180° hybrid. The balun or 180° circuit must in such case be realized at the back side of the PCB, or at a part of the front side of the PCB where it does not interact with the performance of the bowtie antenna arrangement itself.

In one embodiment the two ports are combined by a balun e.g. realized by a 180° hybrid (not shown), as referred to above, on the back side of the metal ground plane or the PCB 9. The two ports can then be differentially excited, the antenna arrangement 10 hence forming a one-port antenna with a single linear polarization.

In an alternative embodiment (not shown), the balun may be provided on the front side of the metal ground plane or the PCB 9.

Each antenna petal 1 comprises a first, planar, connecting portion 2 adapted for connection, e.g. by soldering, screwing or fastening by means of pop rivets, to the front or upper side of the metal ground plane or the PCB 9, a first wall portion 3 forming an angle, e.g. between 70° and 120°, particularly between 80° and 110°, but alternatively any other appropriate angle, with the plane in which the first connecting portion 2 extends, an intermediate mounting portion 5, which preferably is flat and interconnecting said first wall portion 3 with a second wall portion 4 arranged to form a second angle with the plane of extension of said first, planar, connecting portion 2. Said second angle may e.g. also be between 70° and 120°, particularly between 80° and 110°, but alternatively any other appropriate angle, and particularly smaller than the first angle, such that the second walls are disposed in a more slanting, less steep manner with respect to the plane of e.g. the ground plane or the PCB 9. The second wall portion 4, at its end opposite to where it connects to, or turns into, the intermediate mounting portion 5, connects to, or turns into a second connecting end tip portion 6 disposed in the same plane as the first connecting portion and comprising a hole or opening 7 adapted for reception of the connecting pin 12 for connection to a feeding port. The second connecting end tip portion 6 preferably comprises a small, flat rounded portion surrounding opening 7.

The metal-layer of the PCB surface 9 may comprise a hole located under the, or each, second connecting end tip portions 6, in such a way that the connecting end tips rest directly on the dielectric substrate of the PCB and thereby are isolated from the upper metal surface of the PCB. This isolation can also be achieved in other ways, e.g. by a dielectric sheet on top of the PCB.

Due to the shape of the petals 1,1, a bowtie antenna structure 11 is provided which allows surface mounting using SMT (Surface Mount Technology). Particularly, due to the first, planar, connecting portion 2 being flat, surface mounting is facilitated since the petals easily can be lifted. It also becomes possible to mount a number of petals 1 on a PCB or a metal ground plane using a so called placement machine, also called pick-and-place machine. Furthermore, due to the shape of the petal the petals can easily be fabricated in a cost-effective manner through mass-production through punching from a thin metal plate, and pressing. It is also compatible with conventional PCB technology. Preferably a petal is made in one piece. Still further, the petals are attached to the conducting ground plane in any appropriate manner, e.g. by soldering.

Through the inventive concept mass production of bowtie antenna arrangements of different kinds is thus enabled, which is extremely advantageous. Particularly one or more petals can be lifted due to the first, planar, connecting portion 2, which preferably at least partly is flat, and attached to, e.g. soldered onto, a metal ground plane or a PCB, and then baked in an oven.

Different numbers of petals can be arranged on a PCB in different manners, and provide antenna arrangement with different numbers of ports, e.g. a number of differentially excited ports or a number of independently excited ports etc. as will be further exemplified below.

The bowtie antenna arrangement occupies typically an area of the surface that is larger than typically half wavelength at the lowest frequency of operation. Therefore, the PCB mounting is only possible when the wavelength is smaller than and preferably much smaller than the width of the PCB, i.e. at high frequencies. Still, the same surface mountable antenna arrangement can also be used at lower frequency at which it can readily be mounted by other means to the surface and fixed e.g. by using pop rivets. Pop rivets are must faster to use than normal screws.

The surface at which the antenna arrangement is mounted works as a ground plane for the antenna.

Thus, it becomes possible to easily fabricate different antenna arrangements having different numbers of ports, ports excited in different desired manners, having different characteristics and being suitable for different applications, e.g. as elements in a Massive MIMO array for 5G communications systems, but of course also for other implementations.

A bowtie antenna arrangement according to the present invention has a large bandwidth, e.g. up to octave bandwidth or even more. In particular embodiments the PCB comprises a circuit board with micro-strip lines (not shown). Ports e.g. comprising coaxial connectors can be attached to the back side, the front side or to the side edges of the PCB 9 in any desired manner. The bowtie antenna arrangements can also be mounted together with integrated circuits on the same PCB, thereby providing a complete transmitting/receiving device with a massive MIMO array for use in e.g. base stations for 5G.

The bowtie antenna element has a maximum size that is typically about half the wavelength at the lowest frequency of operation. Therefore, the antenna size is typically 10 cm when the lowest frequency is 1.5 GHz, 1 cm when it is 15 GHz, 0.5 cm at 30 GHz, and 0.25 cm at 60 GHz.

In the shown embodiment the second connecting end tip portions 6 are directed towards one another, separated only a slight distance from each other providing a very weak coupling between the ports which is extremely advantageous for MIMO systems.

Hence, although the antenna elements and the central portion are located very close to one another, a very low correlation between the ports is obtained, in particular embodiments even below 0.1 over the range 0.4-16 GHz, which is an extremely good performance. Particularly due to the fact that the arrangement is mainly made by a metal piece, the ohmic losses will be very low.

Figure 1A:
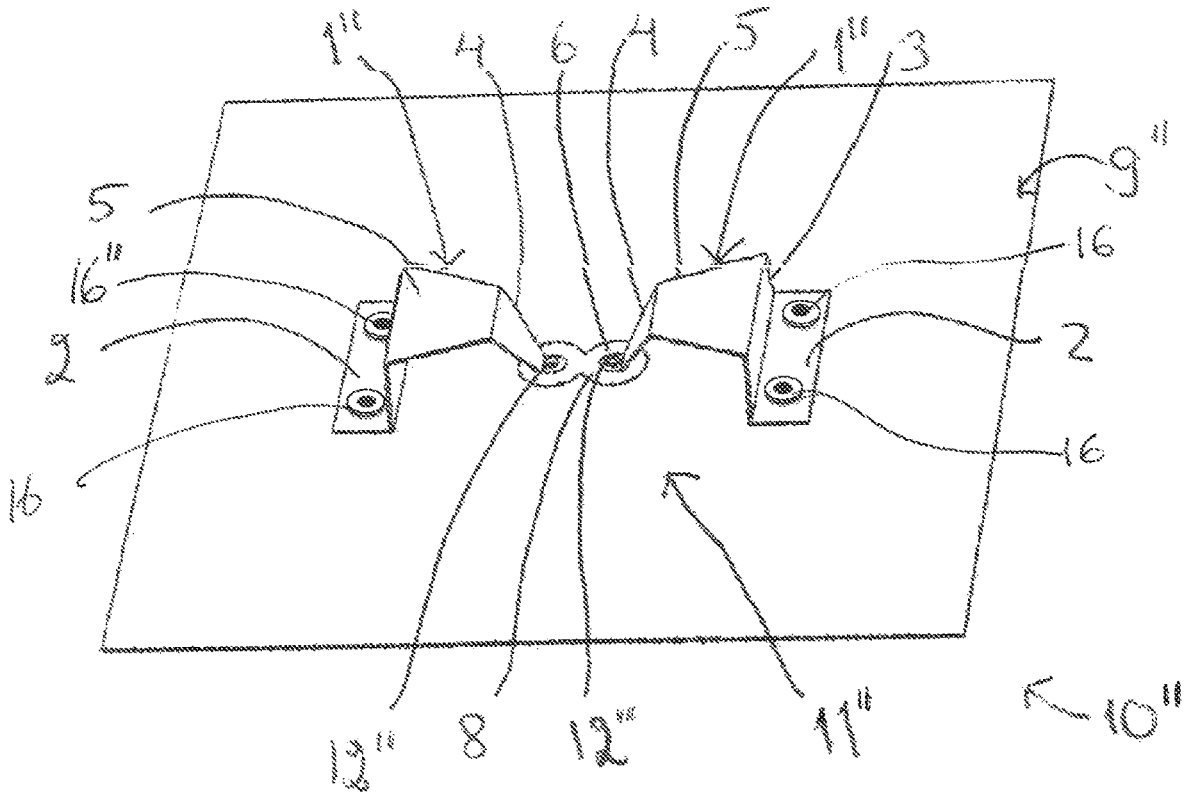
FIG. 1A is a view in perspective of an antenna arrangement of an alternative to the embodiment of FIG. 1, also comprising two antenna petals, corresponding to a linearly-polarized bowtie antenna.

FIG. 1A shows an embodiment similar to the embodiment in FIG. 1 but wherein screws, pop rivets 16" or similar are used for connecting the antenna petals 1",1" to the ground plane or PCB 9", which is particularly advantageous for lower frequencies, but also in other implementations. Still, however, for the central conducting pins 12",12", soldering should be implemented. In other respects, the functioning is similar to that described with reference to FIG. 1, and the same reference numerals are used for the shown elements, which therefore will not be further described herein.

Figure 2:
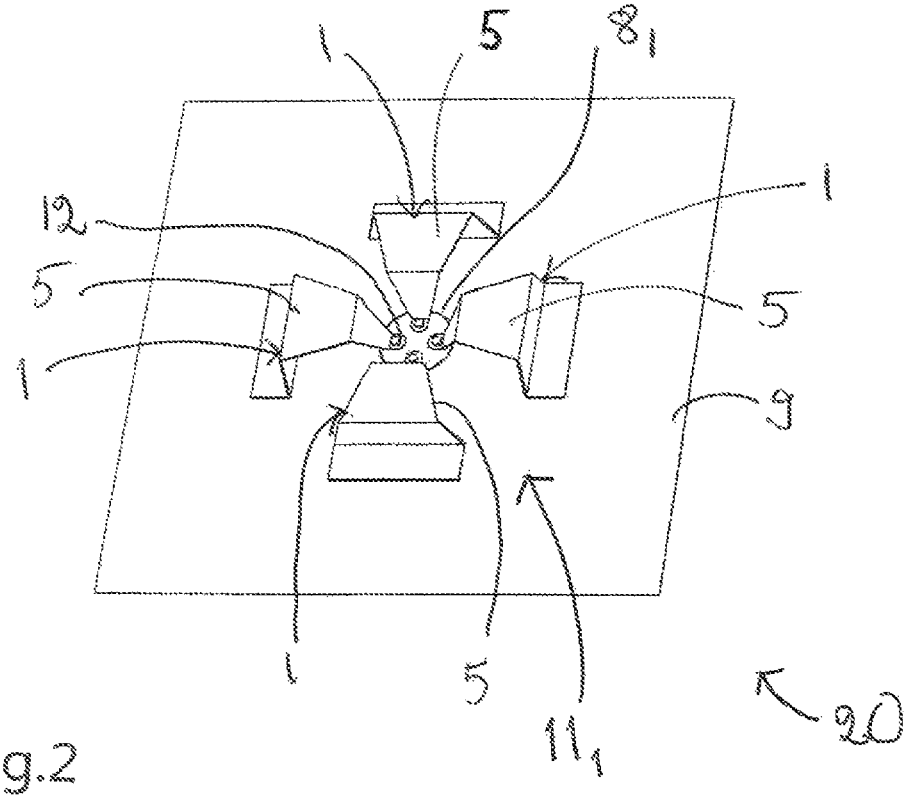
FIG. 2 is a view in perspective of an antenna arrangement with four antenna petals according to a second embodiment, corresponding to a dual-polarized bowtie antenna.

FIG. 2 shows a second embodiment of a bowtie antenna arrangement 20 according to the invention which comprises a bowtie structure $\mathbf{11}_1$ comprising four antenna petals 1,1, 1,1, each of which being made of an electrically conducting material forming an arm as described with reference to FIG. 1. Similar elements bear the same reference numerals as in FIG. 1 and will therefore not be further described here. The end tip portions 6,6,6,6 provided with holes or openings for conducting wires or pins 12, 12 may, as described with reference to FIG. 1, via said conducting pins 12, 12 be connected to microstrip lines and circuits located on the back side of the central portion of the metal ground plane or the PCB 9. A thin dielectric portion $\mathbf{8}_1$ may e.g. be located under the second connecting end tip portions 6. In particular embodiments the four ports are independently excited. In other embodiments the four ports are combined by two baluns, e.g. realized by two 180° hybrids (not shown) disposed on the back side of the metal ground plane or PCB 9. The two horizontally polarized ports can then be differentially excited, as well as the two vertically polarized ports, hence providing a two-port antenna with one port for horizontal polarization and one port for vertical polarization. In still alternative embodiments (not shown), the baluns may be provided on the front or upper side of the metal ground plane or the PCB 9.

Figure 3:
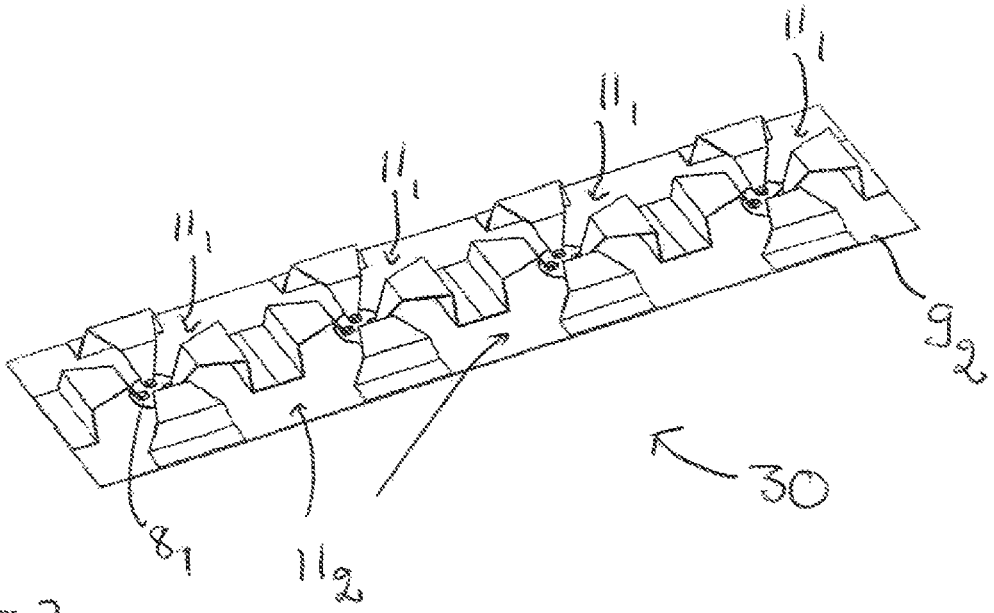
FIG. 3 is a view in perspective of a third embodiment of an antenna arrangement comprising a linear array of four dual-polarized bowtie antenna elements.

FIG. 3 shows a third embodiment of a bowtie antenna arrangement 30 according to the invention which comprises a bowtie structure $\mathbf{11}_2$ comprising four bowtie structures $\mathbf{11}_1$ as disclosed in FIG. 2 arranged in a linear array on a metal ground plane or a PCB $\mathbf{9}_2$. Similar elements bearing the same reference numerals as in FIGS. 1 and 2, have already been discussed with reference to FIGS. 1 and 2 will therefore not be further described here.

In particular embodiments the sixteen ports are independently excited.

In other embodiments the 16 ports are combined by 8 baluns, e.g. realized by 180° hybrids (not shown) disposed on the back side of the metal ground plane or PCB $\mathbf{9}_2$ as discussed above. The horizontally polarized ports can then be differentially excited, as well as the vertically polarized ports, hence providing four two-port bowtie antennas with four ports for horizontal polarization and four ports for vertical polarization. Such an implementation may e.g. be used for an 8-port Massive MIMO base station. It should however be clear that it with advantage also can be used for other applications.

In still alternative embodiments (not shown), the baluns may be provided on the front or upper side of the metal ground plane or the PCB $\mathbf{9}_2$.

Figure 4:
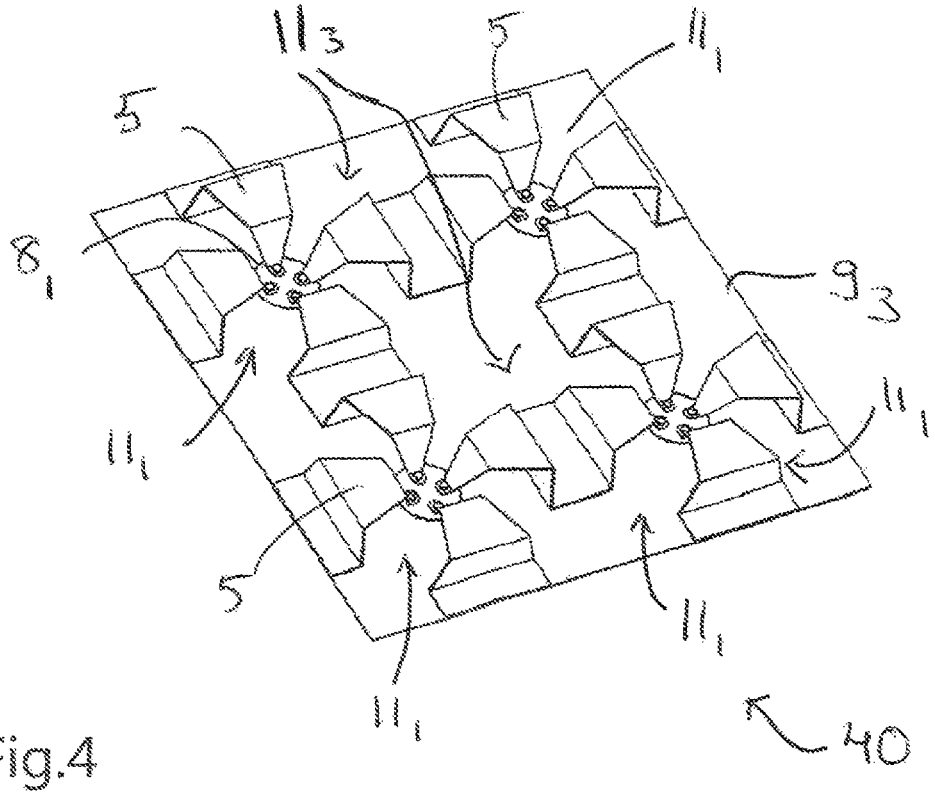
FIG. 4 is a view in perspective of a fourth embodiment of an antenna arrangement comprising a 2×2 planar array of four dual-polarized bowtie antenna elements, i.e. four dual-polarized bowties.

FIG. 4 shows a fourth embodiment of a bowtie antenna arrangement 40 according to the invention which comprises a bowtie structure $\mathbf{11}_3$ comprising four bowtie structures with each for antenna elements or petals $\mathbf{11}_1$ as disclosed in FIG. 2 arranged in a 2×2 planar array on a metal ground plane or a PCB $\mathbf{9}_3$. Similar elements bear the same reference numerals as in FIGS. 1 and 2, and since they have already been discussed with respect to these Figures, they will not be further described here. In particular embodiments the 16 ports are independently excited, whereas in other embodiments the 16 ports are combined by 8 baluns, e.g. realized by 180° hybrids (not shown) disposed on the back side, or alternatively on the front side, of the metal ground plane or PCB $\mathbf{9}_3$ as discussed above. The horizontally polarized ports can then be differentially excited, as well as the vertically polarized ports, hence providing four two-port bowtie antennas with four ports for horizontal polarization and four ports for vertical polarization. Such an implementation may also e.g. be used for an 8-port Massive MIMO base station. It should however be clear that it with advantage also can be used for other applications.

Figure 5:
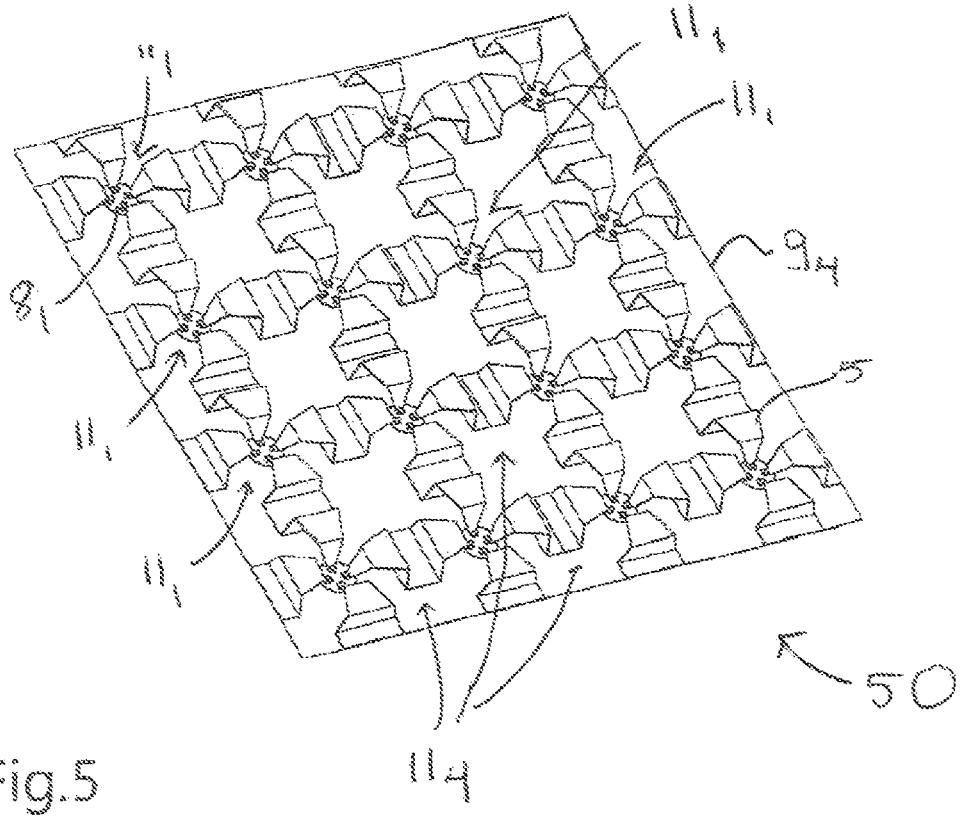
FIG. 5 is a view of a fifth embodiment of an antenna arrangement comprising a 4×4 planar array of 16 dual-polarized bowties.

FIG. 5 shows a fifth embodiment of a bowtie antenna arrangement 50 according to the invention which comprises a bowtie structure $\mathbf{11}_4$ comprising sixteen bowtie structures $\mathbf{11}_1$ with each four antenna elements or petals as disclosed in FIG. 2, arranged in a 4×4 planar array on a metal ground plane or a PCB $\mathbf{9}_4$. Similar elements bear the same reference numerals as in FIGS. 1 and 2, and will therefore not be further described here. In particular embodiments the 64 ports are independently excited, whereas in other embodiments the 64 ports are combined by 32 baluns, e.g. realized by 180° hybrids (not shown) disposed on the back side, or alternatively on the front side, of the metal ground plane or PCB $\mathbf{9}_4$as discussed above. The horizontally polarized ports can then be differentially excited, as well as the vertically polarized ports, hence providing a 32 two-port bowtie antennas with 16 ports for horizontal polarization and 16 ports for vertical polarization. Such an implementation may also e.g. be used for a 32-port Massive MIMO base station. It should however be clear that it with advantage also can be used for other applications.

Figure 6A:
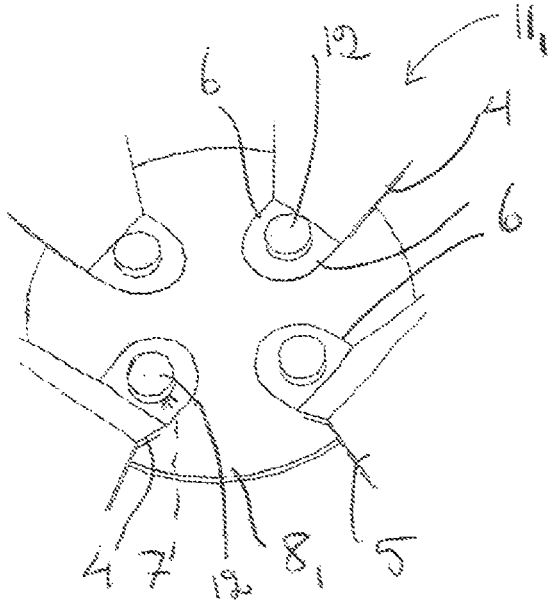
FIG. 6A is a schematic view in perspective illustrating mounting of the central portion of a dual-polarized bowtie antenna structure mounted in a PCB according to one embodiment for high frequencies.

FIG. 6A is a schematic view of the central portion of a bowtie structure $\mathbf{11}_1$, disposed on a thin dielectric film on the central portion of a PCB, showing more in detail parts of the second wall portions 4, first ends of which are connecting to, or turning into, the respective intermediate mounting portions 5 (not shown; see e.g. FIG. 1), and second, opposite ends of which are connecting, or turning, into the second connecting end tip portions 6. Each second connecting end tip portion 6 comprises a respective hole 7 adapted for soldering the conducting pins 12 as discussed above. The small, flat rounded portions of the second connecting end tip portions 6 are here located in a hole or an opening, e.g. etched out, $\mathbf{8}_1$ in the metal surface of the PCB, thereby resting directly on its substrate so that the end tip portions are isolated from the ground plane itself. Alternatively, a thin dielectric film portion $\mathbf{8}_1$ disposed on e.g. the central portion of the PCB (not shown in FIG. 6A) can be used for separating and isolating the connecting end tips from the conducting ground plane. Such implementations are particularly advantageous for high frequencies and small bowties.

Figure 6B:
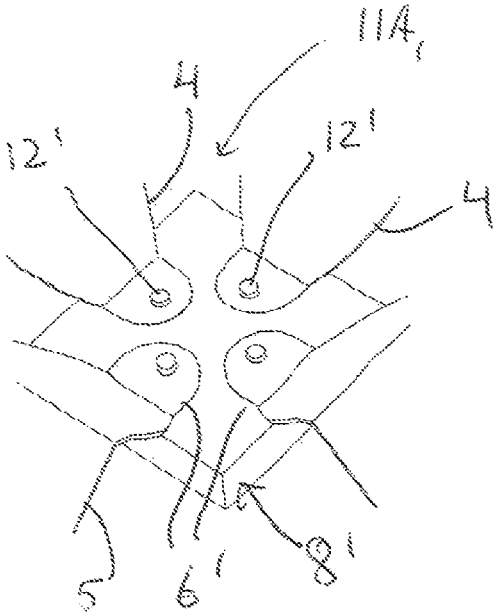
FIG. 6B is a schematic view in perspective of an alternative central portion mounting of a larger bowtie antenna for lower frequencies.

FIG. 6B is a schematic view of the central portion of a bowtie structure $\mathbf{11A}_1$ disposed on a thick dielectric plug 8', e.g. comprising Teflon™, provided in e.g. the central portion of a PCB showing parts of the second wall portions 4, first ends of which connect to, or turn into, the respective intermediate mounting portions 5 (not shown; see e.g. FIG.

1), and second, opposite ends of which connecting or turning into the second connecting end tip portions 6'. Each second connecting end tip portions 6' comprises a respective hole 7' adapted for reception of the connecting pin 12' as discussed above. Thus, the small, flat rounded portions of the second connecting end tip portions 6' are disposed on a dielectric plug 8' which serves the purpose of providing an additional or enhanced mechanical support for the bowtie structure 11$A_1$ at the same time as it provides for isolation towards the ground plane. Such implementations are advantageous for lower frequencies since for lower frequencies generally larger and heavier bowtie structures are required.

In FIGS. 7A-7D some embodiments of antenna petals are illustrated, wherein the antenna petals are shown in a folded, bent shape. In FIGS. 20A-20G below a number of antenna petals, also called antenna petal elements, are illustrated in an unfolded state, i.e. before being shaped for mounting. Punching or similar, and folding or bending into the final shape may be done in different steps or in one and the same step.

Figure 7A:
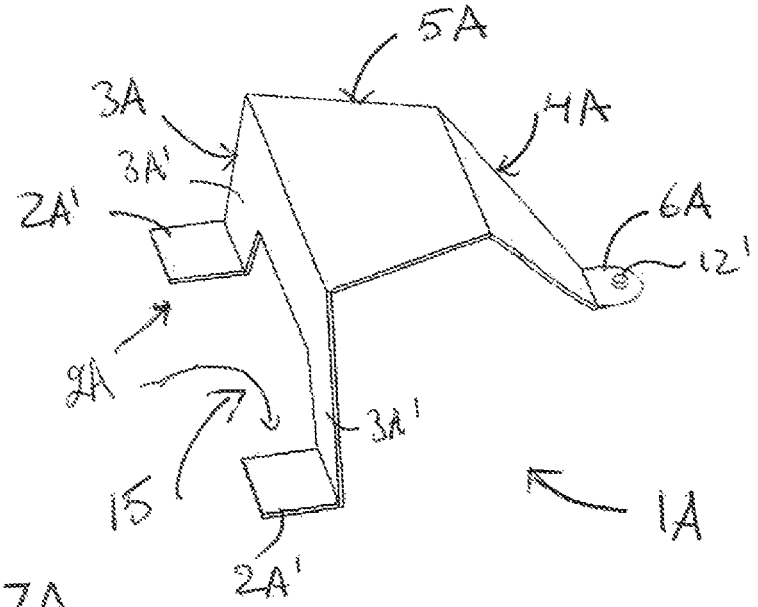
FIG. 7A is a schematic view in perspective of a petal of an alternative antenna element, provided with a slot for alternative antenna arrangements.

FIG. 7A thus shows an embodiment of a bowtie antenna petal 1A made of an electrically conducting material forming an arm section. The petal 1A comprises a first, planar, connecting portion 2A adapted for connection to a front or upper side of a metal ground plane or a PCB similar to the petal 1 of e.g. FIG. 1. The petal 1A comprises a first wall portion 3A, a second wall portion 4A forming an angle with the plane in which the first connecting portion 2A extends, an intermediate mounting portion 5A, which preferably is flat, interconnecting said first wall portion 3A with the second wall portion 4A which is arranged to form a second angle with the extension of said first, planar, connecting portion 2A. The first, planar, connecting portion 2A comprises two leg sections 2A',2A' separated by a slot 15, and also a lower portion of the first wall portion 3A comprises two leg sections 3A',3A' separated by the slot 15, wherein the respective leg sections of the first wall portion 3A and of the first, planar, connecting portion 2A are co-located and of the same width in the zone where the first, planar, connecting portion 2A turns into the first wall portion 3A. In other respects the petal 1A is similar to the petal 1 described with reference to FIG. 1, and the second wall portion 4A, at its end opposite to where it connects to, or turns into, the intermediate mounting portion 5A, connects to, or turns into the second connecting end tip portion 6A disposed in the same plane as the first connecting portion and comprises a hole 7A adapted for soldering a conducting wire or pin going through a hole in the ground plane for connecting the petal to a circuit below the ground plane. Also in this embodiment the second connecting end tip portion 6A preferably comprises a small, flat rounded portion surrounding opening 7A.

The purpose of the slot 15 is to improve the performance by enhancing bandwidth by reducing $|S_{11}|$, the embedded input reflection coefficient, $S_{11}$, which is a measure of the reflection at the port. Alternative embodiments of antenna elements with slots are shown in FIGS. 20C-20G below.

Figure 7B:
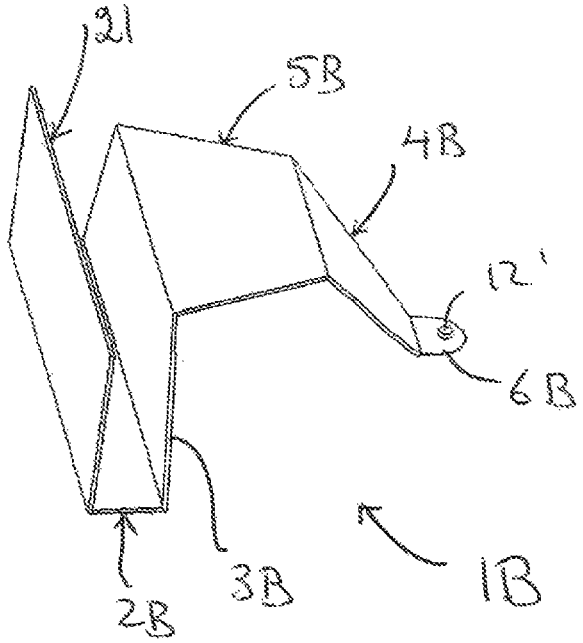
FIG. 7B is a schematic view in perspective of a petal of an alternative antenna element, provided with a corrugation for other alternative antenna arrangements.

FIG. 7B shows an alternative embodiment of an antenna petal 1B made of an electrically conducting material forming an arm section. The petal 1B comprises a first, planar, connecting portion 2B adapted for connection to a top or upper side of a metal ground plane or a PCB as the petal 1 of e.g. FIG. 1. The petal 1B further comprises a first wall portion 3B forming an angle with the plane in which the first connecting portion 2B extends, an intermediate mounting portion 5B, which preferably is flat, interconnecting said first wall portion 3B with a second wall portion 4B arranged to form a second angle with the extension of said first, planar, connecting portion 2B. The first, planar, connecting portion 2B connects, or turns into a wall portion 21 which extends substantially in parallel to the first wall portion 3B and is of substantially the same height, or somewhat higher, or even lower. Hence a groove is formed by said wall portion 21 and said first wall portion 3B. In other respects the petal 1B is similar to the petal 1 described with reference to FIG. 1, and the second wall portion 4B, at its end opposite to where it connects to, or turns into, the intermediate mounting portion 5A, connects to, or turns into, the second connecting end tip portion 6A disposed in the same plane as the first connecting portion and comprising a hole 7B adapted for soldering a wire or pin connecting to circuits on the back side of the ground plane. Also in this embodiment the second connecting, end tip, portion 6B preferably comprises a small, flat rounded portion surrounding opening 7B.

The purpose of the wall 21 is to improve performance by reducing $|S_{11}|$, reducing mutual coupling between antenna ports, and improve the radiation pattern, and to provide a constant gain and beam width over the desired frequency band.

Figure 7C:
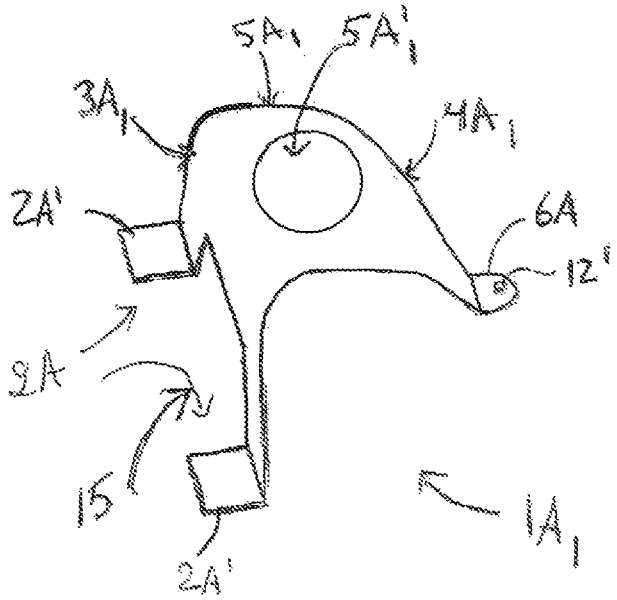
FIG. 7C is a schematic view in perspective of a petal of an alternative antenna element, with a curved petal profile with a circular flat mounting portion on the top for alternative antenna arrangements.

FIG. 7C shows another alternative embodiment of an antenna petal 1$A_1$ made of an electrically conducting material forming an arm section. The petal 1$A_1$ comprises a first, planar, connecting portion 2A comprising two leg sections 2A',2A' adapted for connection to a front or upper side of a metal ground plane or a PCB similar to the petal 1A of FIG. 7A. The petal 1$A_1$ hence also comprises a first wall portion 3$A_1$, a second wall portion 4$A_1$ forming an angle with the plane in which the first connecting portion 2A extends and an intermediate mounting portion 5$A_1$. The intermediate mounting portion 5$A_1$ here comprises a slightly curved or rounded portion with a circular flat mounting portion 5$A_1$' e.g. at the top, and interconnects said first wall portion 3$A_1$ with the second wall portion 4$A_1$ which is arranged to form a second angle with the extension of said first, planar, connecting portion leg sections 2A',2A'. The first, planar, connecting portion leg sections 2A',2A' are separated by a slot 15, and also a lower portion of the first wall portion 3$A_1$ as also described with reference to FIG. 7A, comprises two leg sections separated by the slot 15, wherein the respective leg sections of the first wall portion 3$A_1$ and of the first, planar, connecting portion 2$A_1$ are co-located and of the same width in the zone where the first, planar, connecting portion turns into the first wall portion 3$A_1$.

In this as well as other aspects the embodiment shown in 7C are similar to those described with reference to FIG. 7A, and will therefore no be further described here. It should be clear that an antenna petal 1$A_1$ comprising a top flat portion e.g. circular or of any other appropriate shape, and a curved or rounded intermediate section 5$A_1$ as described above in still other embodiments can be combined with a wall section and a groove e.g. as in FIG. 7B, or with an extended wall section as in FIG. 18 below, be without any slot e.g. as in FIG. 1, FIG. 20A, FIG. 20B, with other slots, e.g. as in FIGS. 20C-20G, and/or be adapted for attachment to the ground plane or PCB by means of screws or pop rivets as in FIG. 1. Many variations are possible.

Figure 7D:
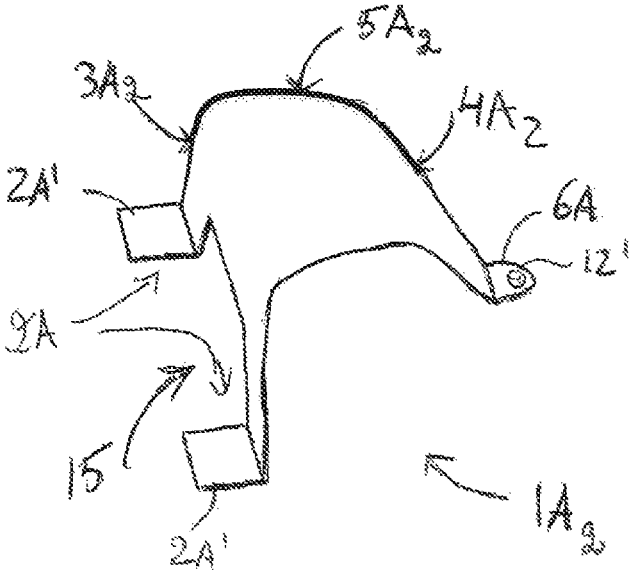
FIG. 7D is a schematic view in perspective of a petal of an alternative antenna element, with a curved petal profile without a flat mounting portion on the top for alternative antenna arrangements.

FIG. 7D shows still another alternative embodiment of an antenna petal 1$A_2$ made of an electrically conducting material forming an arm section. The petal 1$A_2$ comprises a first, planar, connecting portion 2A comprising two leg sections 2A',2A' adapted for connection to a front or upper side of a metal ground plane or a PCB similar to the petal 1A of FIG. 7A. The petal 1$A_2$ also comprises a first wall portion 3$A_2$, a second wall portion 4$A_2$ forming an angle with the plane in which the first connecting portion 2A extends and an intermediate mounting portion $5A_2$. The intermediate mounting portion $5A_2$ here comprises a curved petal profile, without any flat mounting section, and interconnects said first wall portion $3A_2$ with the second wall portion $4A_2$ which is arranged to form a second angle with the extension of said first, planar, connecting portion leg sections 2A',2A'. The first, planar, connecting portion leg sections 2A',2A' are also in this embodiment separated by a slot 15, as a lower portion of the first wall portion $3A_1$ which, as also described with reference to FIG. 7A, comprises two leg sections separated by the slot 15, wherein the respective leg sections of the first wall portion $3A_2$ and the first, planar, connecting portion $2A_2$ are co-located and of the same width in the zone where the first, planar, connecting portion turns into the first wall portion $3A_2$. In this as well as other aspects the embodiment shown in 7D are similar to those described with reference to FIG. 7A, and will therefore no be further described here. It should be clear that an antenna petal $1A_2$ comprising a curved or rounded intermediate section $5A_2$ as shown in FIG. 7D in still other embodiments can be combined with a wall section and a groove e.g. as in FIG. 7B, or with an extended wall section as in FIG. 18 below, be without any slot e.g. as in FIG. 1, FIG. 20A, FIG. 20B, with other slots, e.g. as in FIGS. 20C-20G, and/or be adapted for attachment to the ground plane or PCB by means of screws or pop rivets as in FIG. 1. Many variations are possible.

Figure 8:
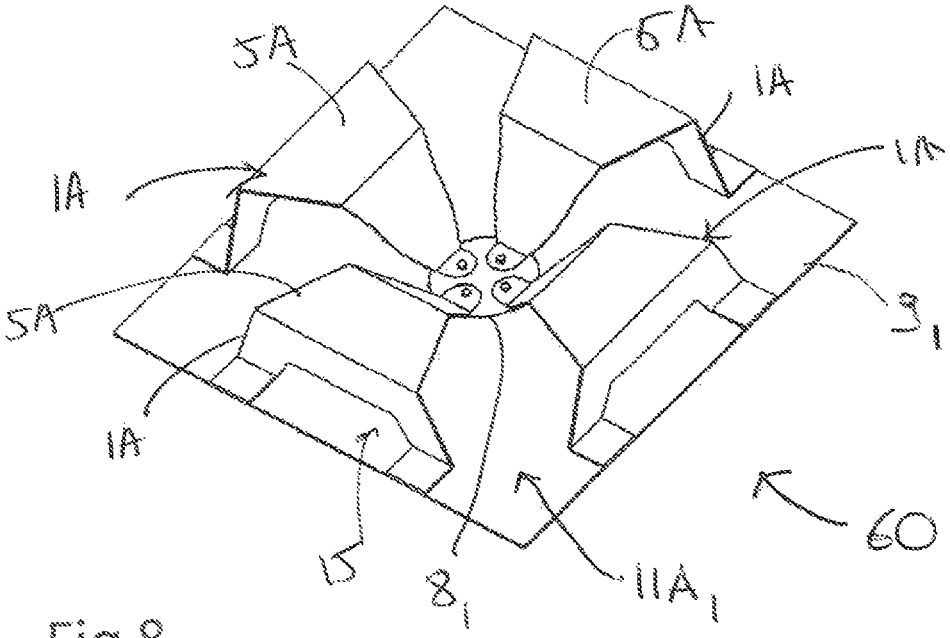
FIG. 8 is a view in perspective of a dual-polarized bowtie antenna element comprising petals with slots as in FIG. 7A according to a sixth embodiment of the invention.

FIG. 8 shows an embodiment of an antenna arrangement 60 similar to the embodiment in FIG. 2, but with the difference that the bowtie antenna elements comprise petals 1A as in FIG. 7A. Thus, the bowtie antenna arrangement 60 comprises a bowtie structure $11A_1$ comprising four antenna petals 1A,1A,1A,1A, each of which being made of an electrically conducting material forming an arm section as described with reference to FIG. 1. Similar elements bear the same reference numerals as in FIG. 7A and in FIG. 1, but are referenced "A", and will therefore not be further described here.

The end tip portions 6A,6A,6A,6A provided with holes or openings for soldering wires or pins 12,12 may, as also described with reference to FIG. 1, connect to coaxial or microstrip lines or circuits located on the back (or front) side of the metal ground plane or the PCB 9A. In particular embodiments the four ports are independently excited. In other embodiments the four ports are combined by two baluns, e.g. realized by two 180° hybrids (not shown) disposed on the back (or front) side of the metal ground plane or PCB 9A. The two horizontally polarized ports can then be differentially excited, as well as the two vertically polarized ports, hence providing a two-port antenna with one port for horizontal polarization and one port for vertical polarization.

Figure 9:
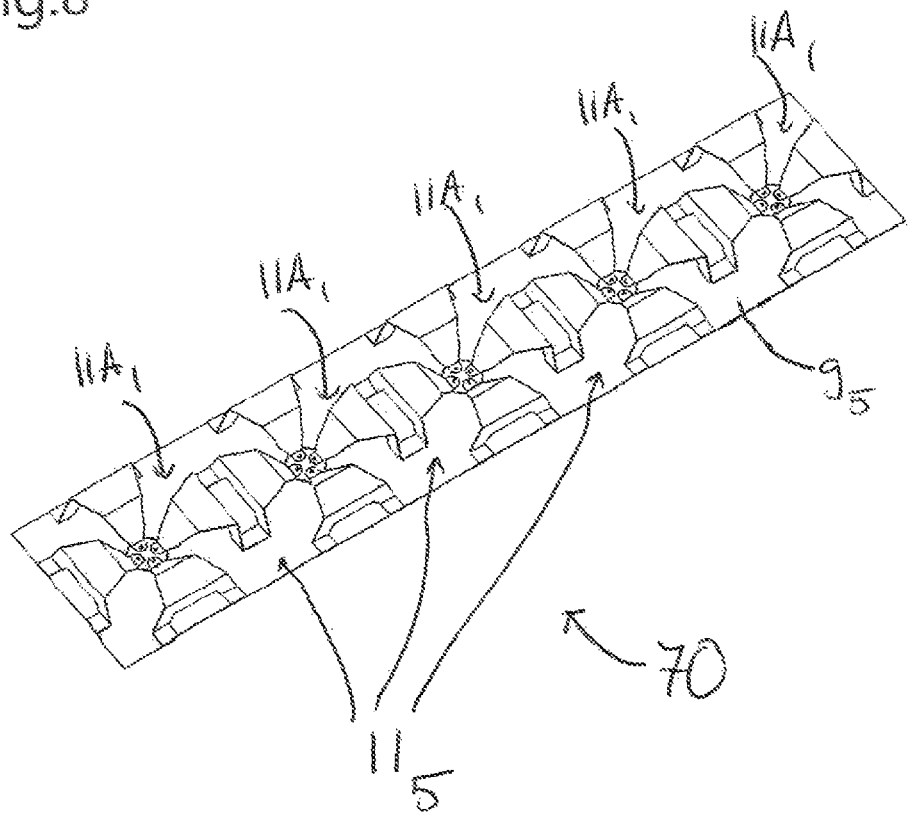
FIG. 9 is a view in perspective of a dual-polarized bowtie antenna element comprising petals with slots as in FIG. 7A, arranged in a linear array according to a seventh embodiment of the invention.

FIG. 9 shows an embodiment of a bowtie antenna arrangement 70 according to the invention which comprises a bowtie structure $11_5$ comprising five bowtie structures $11_{A1}$, each comprising four antenna petals 1A, as disclosed in FIG. 8 arranged in a linear array on a metal ground plane or a PCB $9_5$. Similar elements bear the same reference numerals as in FIG. 8 and will therefore not be further described here. In particular embodiments the sixteen ports are independently excited. In other embodiments the 20 ports are combined by 10 baluns, e.g. realized by 180° hybrids (not shown) disposed on the back (or front) side of the metal ground plane or PCB $9_5$ as discussed above. The horizontally polarized ports can then be differentially excited, as well as the vertically polarized ports, hence providing four two-port bowtie antennas with four ports for horizontal polarization and four ports for vertical polarization. Such an implementation may e.g. with advantage be used for an 8-port Massive MIMO base station. It should however be clear that it with advantage also can be used for other applications.

Figure 10:
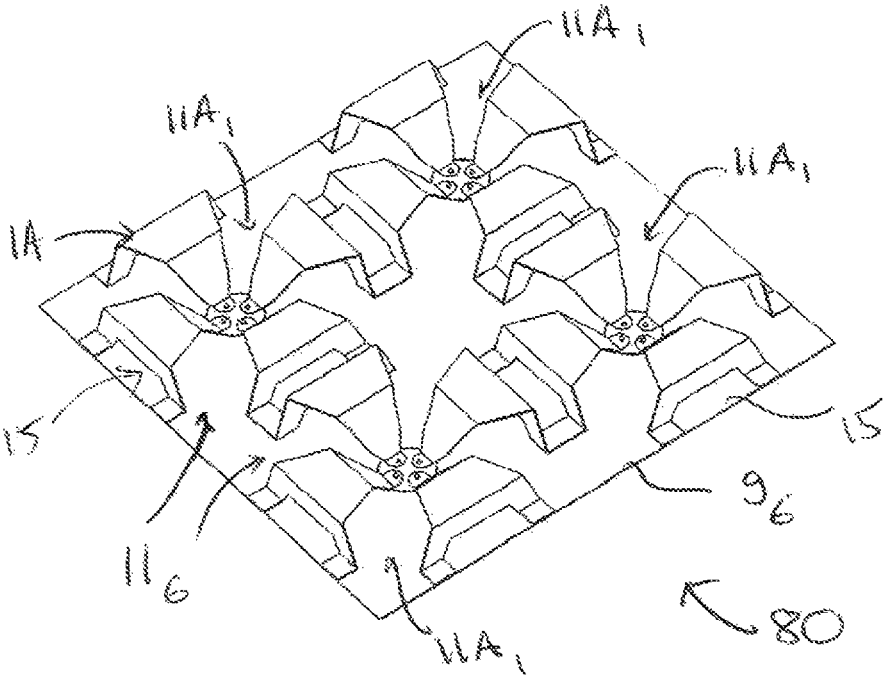
FIG. 10 is a view in perspective of dual-polarized bowtie antenna element comprising petals with slots as in FIG. 7A, arranged in a 2×2 planar array as in FIG. 4, according to an eighth embodiment of the invention.

FIG. 10 shows an of a bowtie antenna arrangement 80 which comprises a bowtie structure $11_6$ comprising four bowtie structures $11_{A1}$, each comprising four antenna petals 1A, as disclosed in FIG. 7A arranged in a 2×2 planar array on a metal ground plane or a PCB $9_6$. Similar elements bear the same reference numerals as in FIG. 8, and will therefore not be further described here. In particular embodiments the sixteen ports are independently excited, alternatively, in other embodiments, the 16 ports are combined by 8 baluns, e.g. realized by 180° hybrids (not shown) disposed on the back (or top) side of the metal ground plane or PCB $9_6$ as discussed above. The horizontally polarized ports can then be differentially excited, as well as the vertically polarized ports, hence providing four two-port bowtie antennas with four ports for horizontal polarization and four ports for vertical polarization. Such a bowtie antenna arrangement 80 may also e.g. be used for an 8-port Massive MIMO base station. It should however be clear that it with advantage also can be used for other applications.

Figure 11:
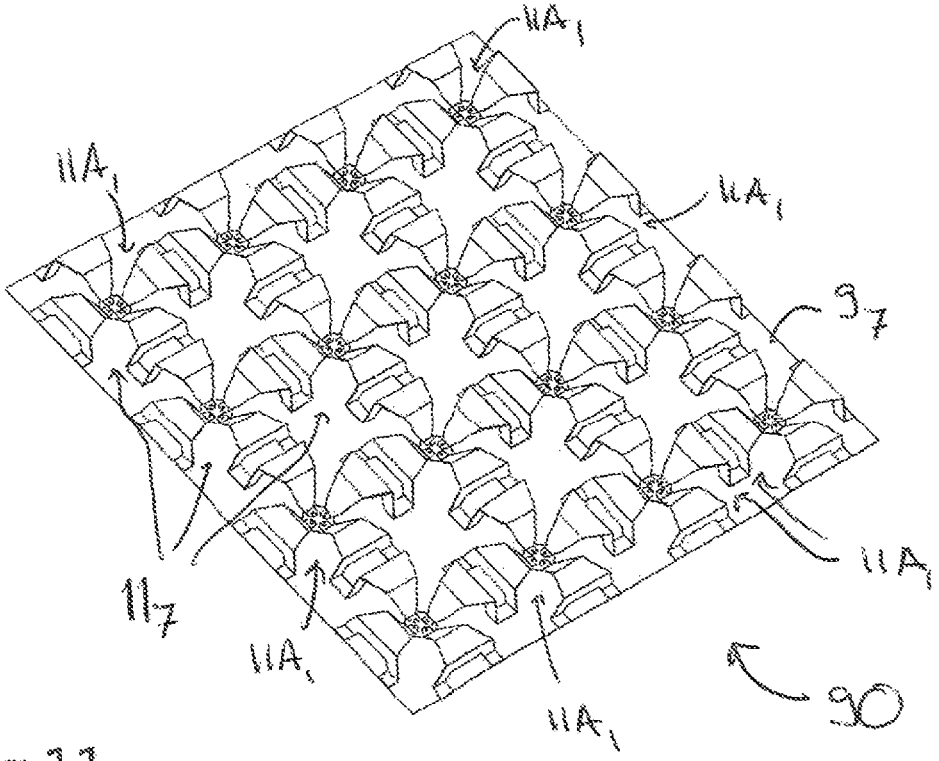
FIG. 11 is a view in perspective of a dual-polarized bowtie antenna element comprising petals with slots as in FIG. 7A arranged in 4×4 planar array as in FIG. 5, according to a ninth embodiment of the invention.

FIG. 11 shows an embodiment of a bowtie antenna arrangement 90 which comprises a bowtie structure $11_7$ comprising sixteen bowtie structures $11A_1$, each comprising four petals 1A, as disclosed in FIG. 8 and which are arranged in a 4×4 planar array on a metal ground plane or a PCB $9_7$. Similar elements bear the same reference numerals as in FIG. 8 and will therefore not be further described here. In some embodiments the 64 ports may independently excited, or alternatively, in other embodiments, the 64 ports are combined by 32 baluns, e.g. realized by 180° hybrids (not shown) disposed on the back (or front) side of the metal ground plane or PCB $9_7$ as also discussed earlier in the present application. The horizontally polarized ports can then be differentially excited, as well as the vertically polarized ports, hence providing a 32 two-port bowtie antennas with 16 ports for horizontal polarization and 16 ports for vertical polarization.

An implementation with 32 two-port bowtie antennas with 16 ports for horizontal polarization and 16 ports for vertical polarization may e.g. be used for a 32-port Massive MIMO base station. It should however be clear that it with advantage also can be used for other applications.

Figure 12:
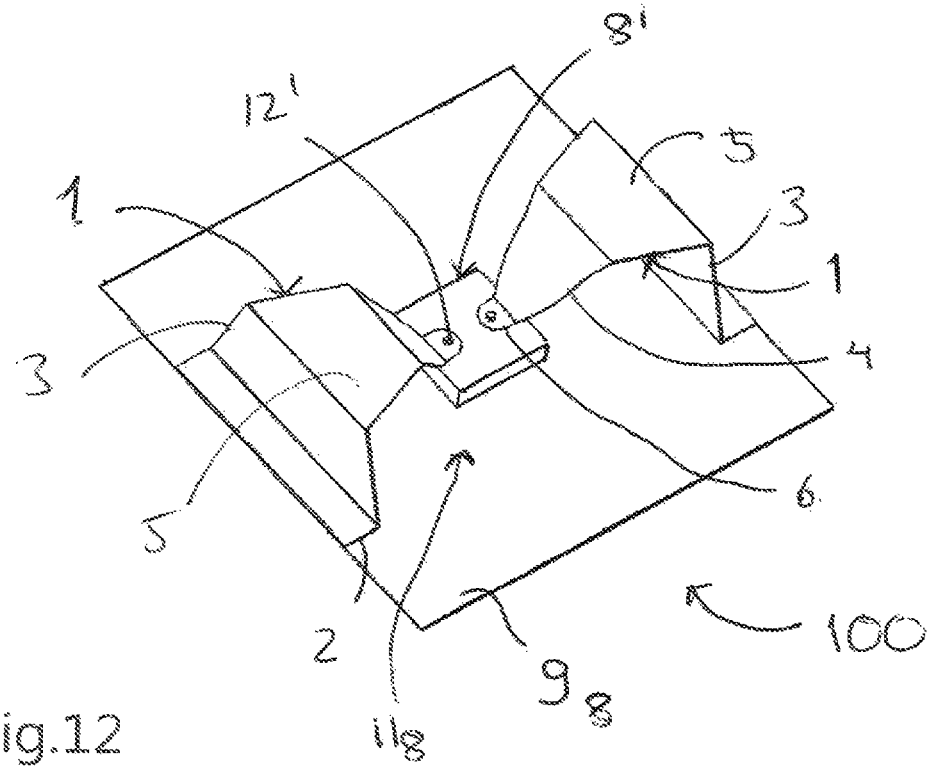
FIG. 12 is a view in perspective of an antenna single-linearly-polarized bowtie antenna element comprising petals without slots and with two antenna ports according to a tenth embodiment of the invention.

FIG. 12 shows an embodiment of a straight sided bowtie antenna arrangement 100 which comprises a bowtie structure $11_8$ similar to the bowtie structure described with reference to FIG. 1, but with the difference that it comprises a thick dielectric plug 8' as disclosed in FIG. 6B to enhance mechanical strength and stability where the pins and wires are coming through holes in the ground plane, and thus also is appropriate for use for lower frequencies, e.g. for base stations for 3G or 4G frequency bands, requiring larger bowtie structures. In other respects the elements and their functioning is similar to that of corresponding elements described with reference to preceding embodiments and will therefore not be further described herein.

Figure 13:
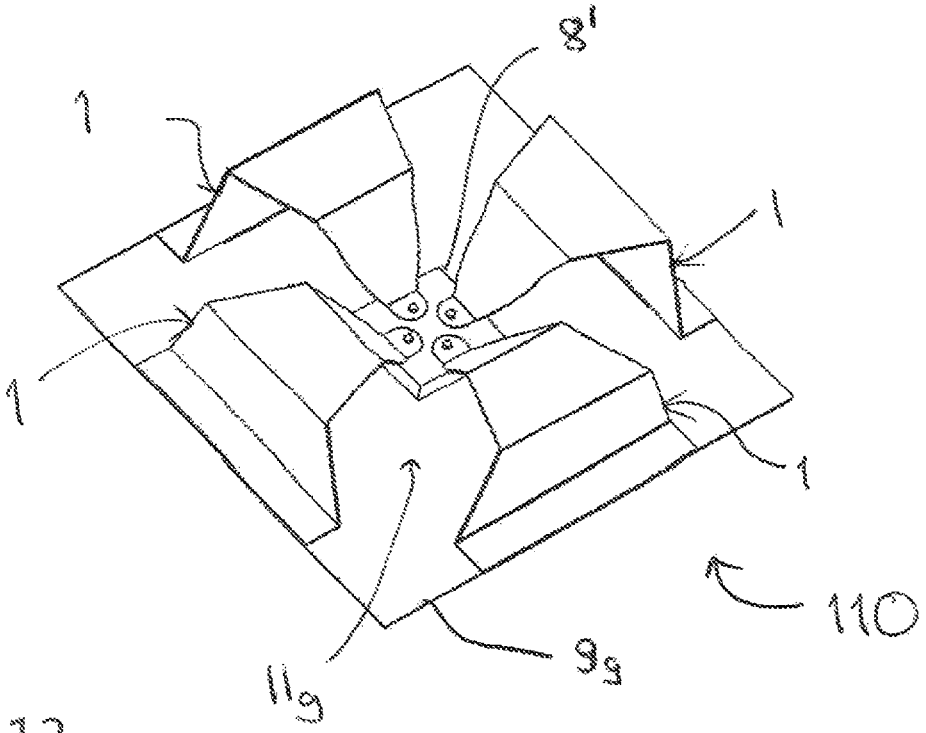
FIG. 13 is a view in perspective of a dual-polarized bowtie antenna element comprising without slots according to an eleventh embodiment of the invention.

FIG. 13 shows an embodiment of a bowtie antenna arrangement 110 which comprises a bowtie structure $11_9$ similar to the embodiment described with reference to FIG. 2, but comprising a thick dielectric plug 8' as also described with reference to FIGS. 6B and 12. Elements already described with reference to preceding FIGS. 1, 2 and 12 will not be further described here. In some embodiments the four ports are independently excited, whereas in other embodiments the four ports are combined by two baluns, e.g.

realized by two 180° hybrids (not shown) disposed on the back (or front) side of the metal ground plane or PCB $9_9$. The two horizontally polarized ports can then be differentially excited, as well as the two vertically polarized ports, hence providing a two-port antenna with one port for horizontal polarization and one port for vertical polarization.

Figure 14:
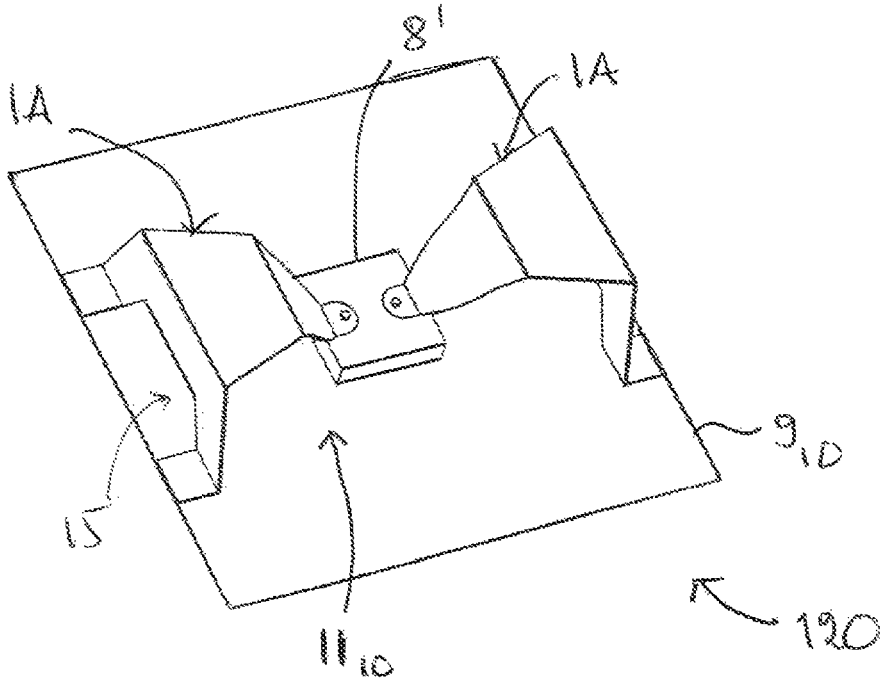
FIG. 14 is a view in perspective of a single-linearly-polarized bowtie antenna element comprising petals with slots as in FIG. 7A and according to a twelfth embodiment of the invention.

FIG. 14 shows an embodiment of a straight sided bowtie antenna arrangement 120 which comprises a bowtie structure $11_{10}$ similar to the bowtie structure described with reference to FIG. 12, but with the differences the two antenna petals 1A,1A include slots as described with reference to FIG. 7A. Since it comprises a thick dielectric plug 8' enhancing mechanical strength and stability as disclosed in FIG. 6B, it is convenient for use for lower frequencies, e.g. for base stations for 3G and 4G systems, requiring larger bowtie structures. In other respects the elements and their functioning is similar to that of corresponding elements described with reference to the embodiments of FIGS. 6B, 7A, 12 and they will therefore not be further described herein.

Figure 15:
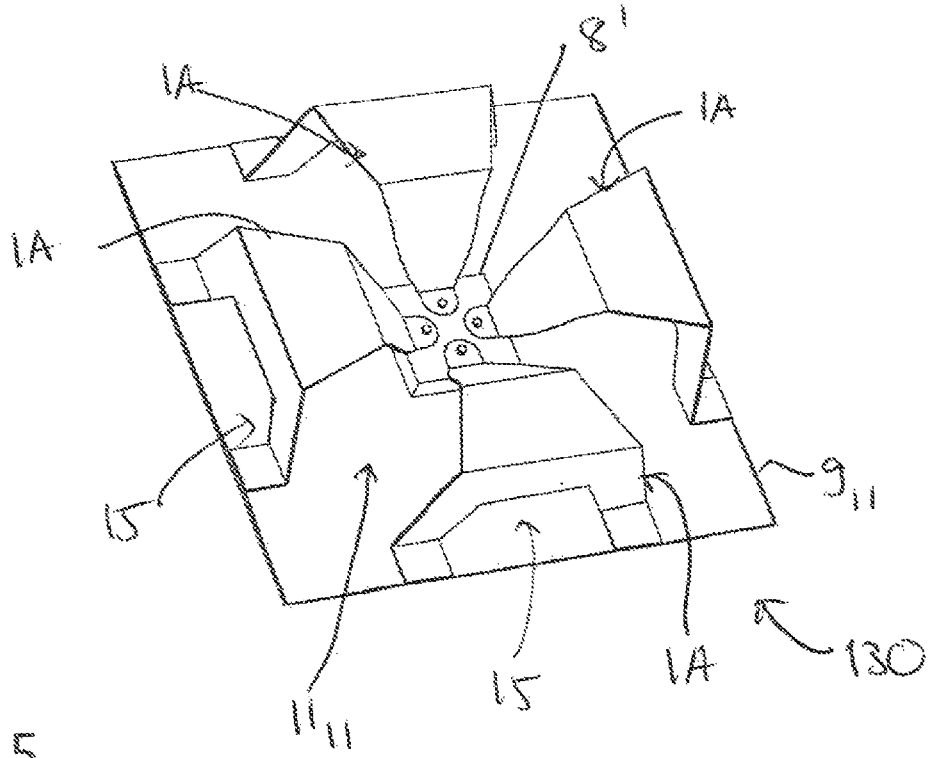
FIG. 15 is a view in perspective of a dual-polarized bowtie antenna element comprising petals with slots as in FIG. 7A according to a thirteenth embodiment of the invention.

FIG. 15 shows an embodiment of a bowtie antenna arrangement 130 which comprises a bowtie structure $11_{11}$ similar to the embodiment described with reference to FIG. 2, but comprising four antenna elements or four petals 1A,1A,1A,1A as described with reference to FIG. 7A and a thick dielectric plug 8' as also described with reference to FIGS. 6B and 14. Elements already described with reference to preceding FIGS. 1, 2, 6B, 7A and 14 will not be further described herein. In particular embodiments the four ports are independently excited, whereas in other embodiments the four ports are combined by two baluns, e.g. realized by two 180° hybrids (not shown) disposed on the back (or front) side of the metal ground plane or PCB $9_{11}$. The two horizontally polarized ports can then be differentially excited, as well as the two vertically polarized ports, hence providing a two-port antenna with one port for horizontal polarization and one port for vertical polarization.

The bowtie antenna arrangement 130 is particularly suitable for lower frequencies requiring larger bowties, and is advantageous in that performance is enhanced due to the slots as discussed with reference to FIG. 7A.

Figure 16:
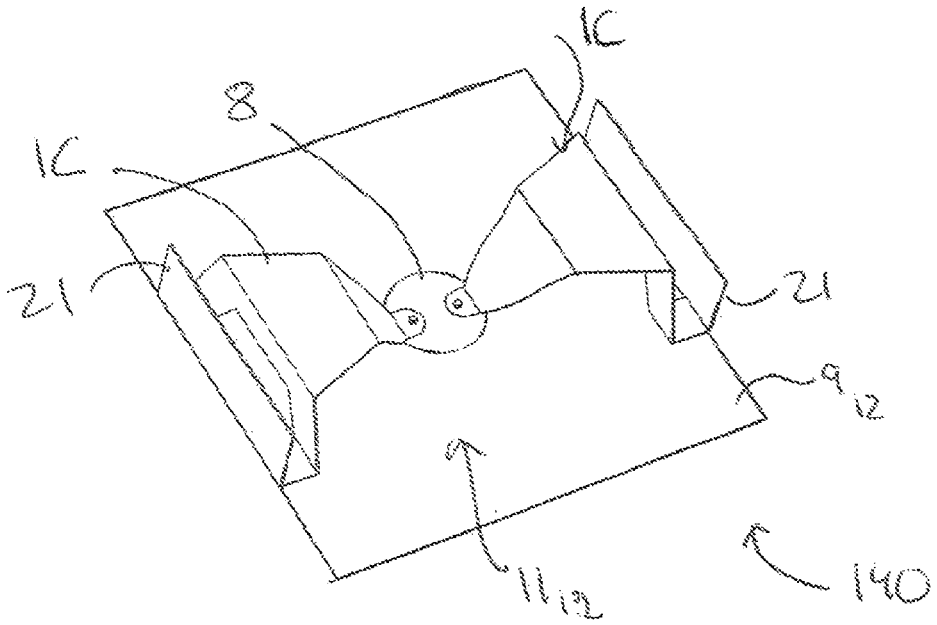
FIG. 16 is a view in perspective of a single-linearly-polarized bowtie antenna comprising petals with slots and with corrugations as in FIGS. 7A and 7B according to a fourteenth embodiment of the invention.

FIG. 16 shows an embodiment of a straight sided bowtie antenna arrangement 140 which comprises a bowtie structure $11_{12}$ similar to the bowtie structure described with reference to FIG. 1 with the differences that it comprises two antenna petals 1C,1C each comprising a slot as disclosed in FIG. 7A and a wall 21 as disclosed in FIG. 7B to even further enhance the performance as also discussed with reference to FIGS. 7A and 7B. It comprises a central hole 8 in the metal layer of the PCB so that the end tips rest directly on its substrate as disclosed in FIG. 1, and thus is most appropriate for use for higher frequencies, e.g. even up to 100-150 GHz as in other described embodiments. In other respects the elements and their functioning is similar to that of corresponding elements described with reference to the preceding embodiments and will therefore not be further described herein.

Figure 17:
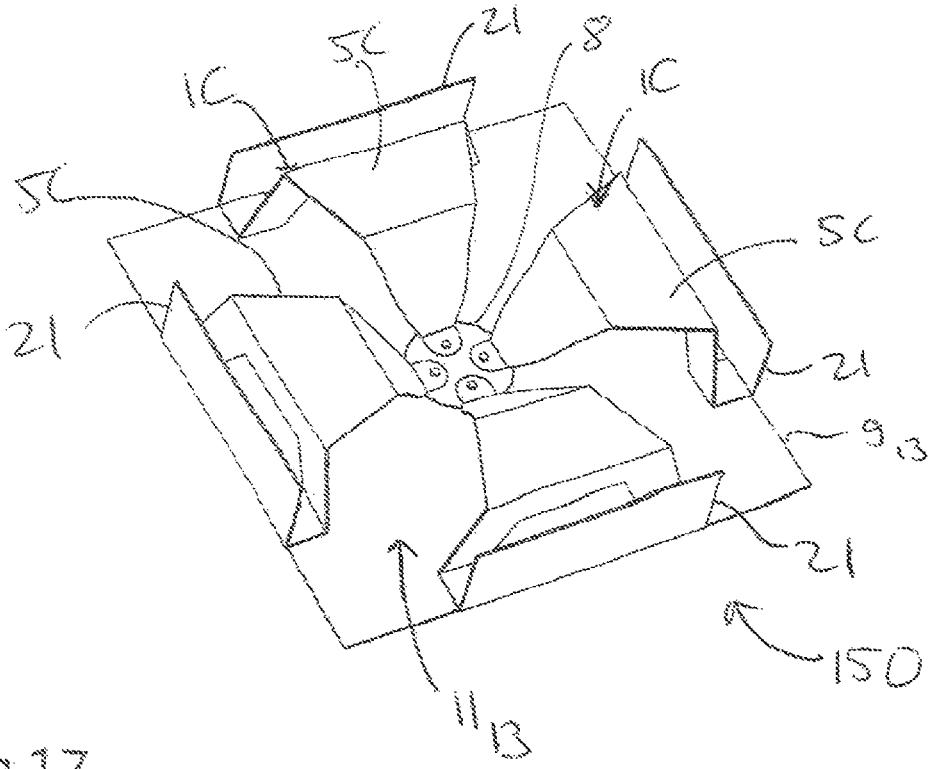
FIG. 17 is a view in perspective of dual-polarized bowtie antenna comprising petals with slots as in FIG. 7A and walls, according to a fifteenth embodiment of the invention.

FIG. 17 shows an embodiment of a bowtie antenna arrangement 150 which comprises a bowtie structure $11_{13}$ similar to the embodiment described with reference to FIG. 2, but comprising four antenna petals 1C,1C,1C,1C as described with reference to FIG. 16 and a thin dielectric section 8 as also described with reference to FIG. 16 and FIG. 6A. Elements already described with reference to preceding FIGS. 1, 2, 7B and 12 will not be further described herein. In particular embodiments the four ports are independently excited, whereas in other embodiments the four ports are combined by two baluns, e.g. realized by two 180° hybrids disposed on the back (or front) side of the metal ground plane or PCB $9_{13}$. The two horizontally polarized ports can then be differentially excited, as well as the two vertically polarized ports, hence providing a two-port antenna with one port for horizontal polarization and one port for vertical polarization. The bowtie antenna arrangement 150 can with advantage be used for higher frequencies, e.g. even, but not exclusively, up to 100-150 GHz.

Figure 18:
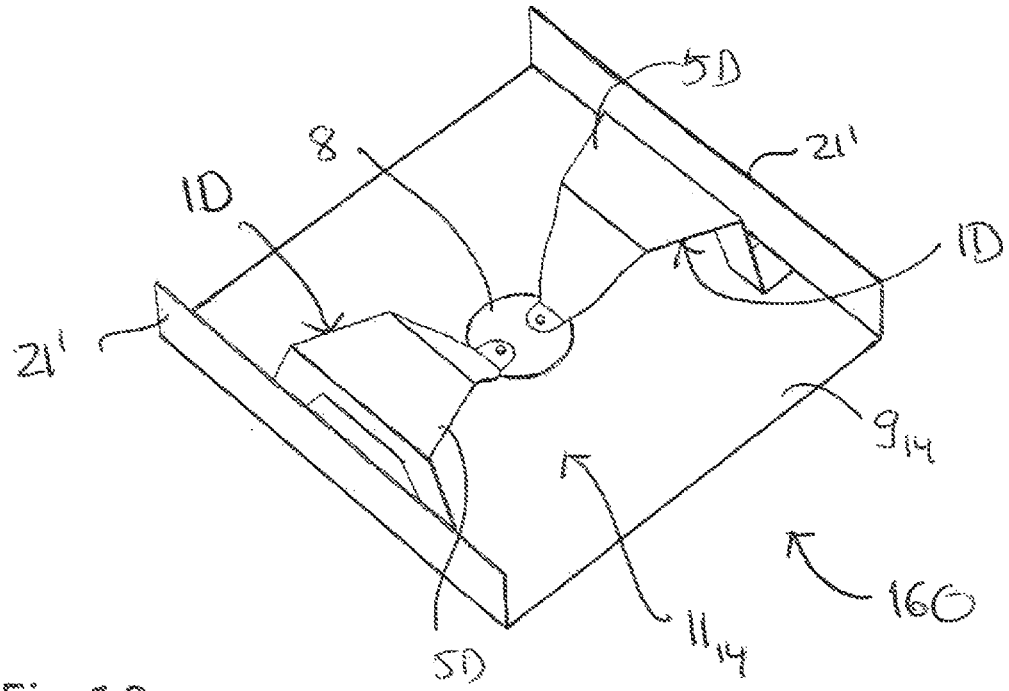
FIG. 18 is a view in perspective of a single-linearly-polarized bowtie antenna comprising petals with slots and with corrugations as in FIGS. 7A and 7B according to a sixteenth embodiment of the invention.

FIG. 18 shows an embodiment of a straight sided bowtie antenna arrangement 160 which comprises a bowtie structure $11_{14}$ similar to the bowtie structure described with reference to FIG. 16, wherein the two antenna petals 1D,1D each comprises both a slot and a wall as disclosed in FIGS. 7A and 7B, but wherein the walls 21' are prolonged to extend all along the respective outer side edges of the PCB $9_{14}$, hence even further enhancing the performance as discussed with reference to FIGS. 7A and 7B. It here comprises a thin dielectric central section 8 as disclosed in FIG. 1, and thus is most appropriate for use for higher frequencies, e.g. even up to 100-150 GHz. In other respects the elements and their functioning are similar to that of corresponding elements described with reference to preceding embodiments and will therefore not be further described herein.

It should be clear that, e.g. for lower frequencies, or to enhance mechanical strength, a thick dielectric plug 8' can be used instead of the thin dielectric central section 8.

In advantageous embodiments the wall 21' has a width approximately corresponding to $\lambda/2$, and the height of the wall is substantially $\lambda/4$, $\lambda$ being the signal wavelength.

Figure 19:
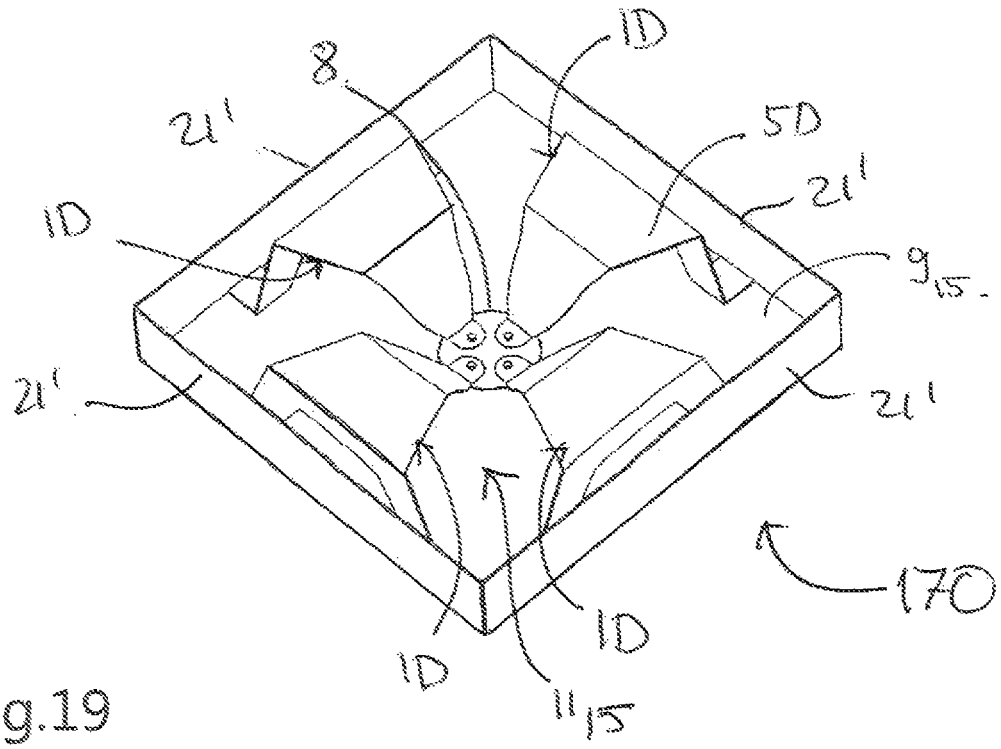
FIG. 19 is a view in perspective of a single-linearly-polarized bowtie antenna comprising petals with slots and walls as in FIG. 17 according to a seventeenth embodiment of the invention.

FIG. 19 shows an embodiment of a bowtie antenna arrangement 170 which comprises a bowtie structure $11_{15}$ similar to the bowtie structure described with reference to FIG. 17, with the difference that the walls 21' are prolonged as described with reference to FIG. 18. Elements already described with reference to preceding FIGS. 1, 2, 7A, 7B and 18 will not be further described here. In particular embodiments the four ports are independently excited, whereas in other embodiments the four ports are combined by two baluns, e.g. realized by two 180° hybrids (not shown) disposed on the back (front) side of the metal ground plane or PCB $9_{15}$. The two horizontally polarized ports, as well as the two vertically polarized ports, can then be differentially excited respectively, hence providing a two-port antenna with one port for horizontal polarization and one port for vertical polarization.

Through the use of petals 1D and extended walls 21', the impedance matching properties will be excellent. The bowtie antenna arrangement 150 can with particular advantage be used for higher frequencies, e.g. even up to 100-150 GHz.

It should also be clear that, also in this embodiment, e.g. for lower frequencies, or to enhance mechanical strength in general, a thick dielectric plug 8' can be used instead of the thin dielectric central section 8.

In advantageous embodiments each wall 21 has a width approximately corresponding to $\lambda/2$, and a height of substantially $\lambda/4$, $\lambda$ being the signal wavelength.

FIGS. 20A-20G show different antenna petal profiles and slot shapes, illustrated in the unfolded state. The dashed lines in the Figures indicate folding lines.

An antenna petal according the invention may be cut out or punched, with or without slots, and subsequently folded in a machine. Alternatively, the cutting or punching operation and the folding or bending operation may be carried out in one step in a machine or using an appropriate tool.

Figure 20A:
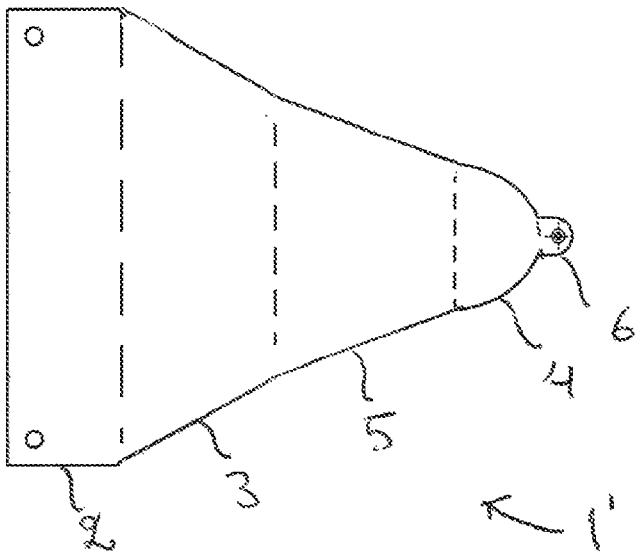
FIG. 20A is a top view of an antenna petal element similar to the antenna petals shown in FIG. 1 before being folded or bent.
Figure 20B:
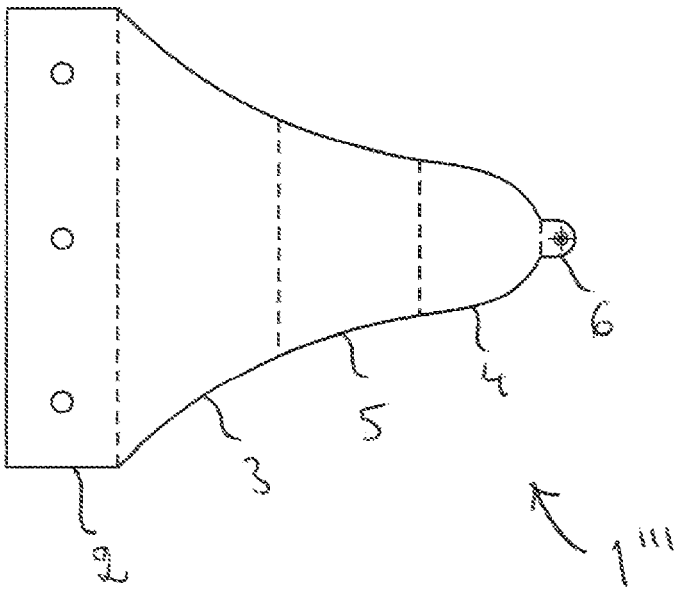
FIG. 20B is a top view of an antenna petal element similar to the antenna petals shown in FIG. 1 but with a slightly modified shape before being folded or bent.

Examples of antenna petals 1',1''', e.g. having shapes similar to that of the antenna petal shown in FIG. 1, without any slots are shown in FIGS. 20A, 20B. In other respects the antenna petals 1' of FIG. 20A and 1''' of FIG. 20B are similar to the antenna petal of FIG. 1, and will therefore not be further described herein, and the same reference numerals are used.

The other different antenna petal elements or profiles have slots along the edges (FIG. 20F, FIG. 20G) or in the central part (FIGS. 20C, 20D, 20E, 20G) of the petal. These shapes are only examples of possible profiles and slots covered by the invention.

The petal profiles and the slots are optimised in order to change the current traces on the petals in such a way that the embedded element pattern of the single-, or dual-polarized bowtie element gets the desired coverage and impedance match over the desired bandwidth. Typically, slots in the wide part of the antenna petal far from the second connecting end tip portion will affect the performance at low frequency, and slots close to the first connecting portion will affect the low frequency performance.

The optimisations are normally done by cut-and-try approach, but they can in more advanced studies be done by advanced numerical optimisation using generic algorithms.

Figure 20C:
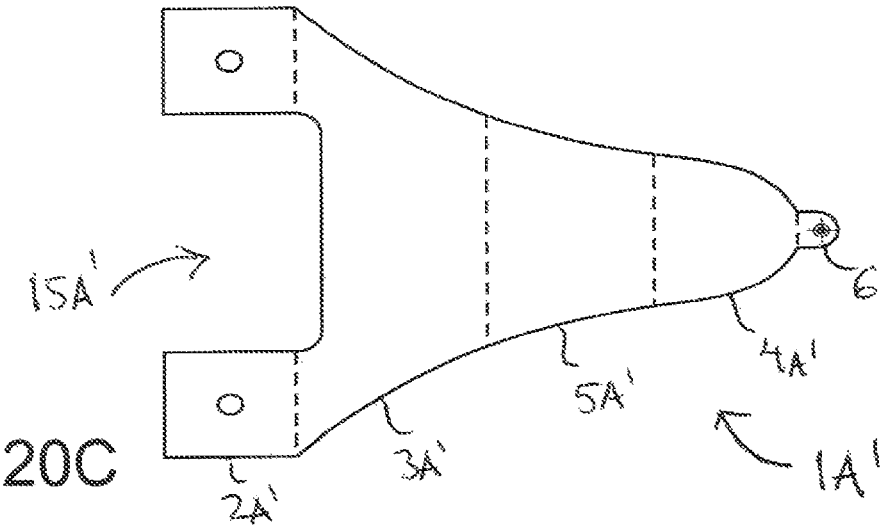
FIG. 20C is a top view of an antenna petal element substantially similar to the antenna petal shown in FIG. 7A before being folded or bent.

Particularly, FIG. 20C shows an antenna petal 1A' with an open slot 15A' substantially similar to the embodiment shown in FIG. 7A, and therefore the same reference numerals are used for other parts of the antenna petal.

Figure 20D:
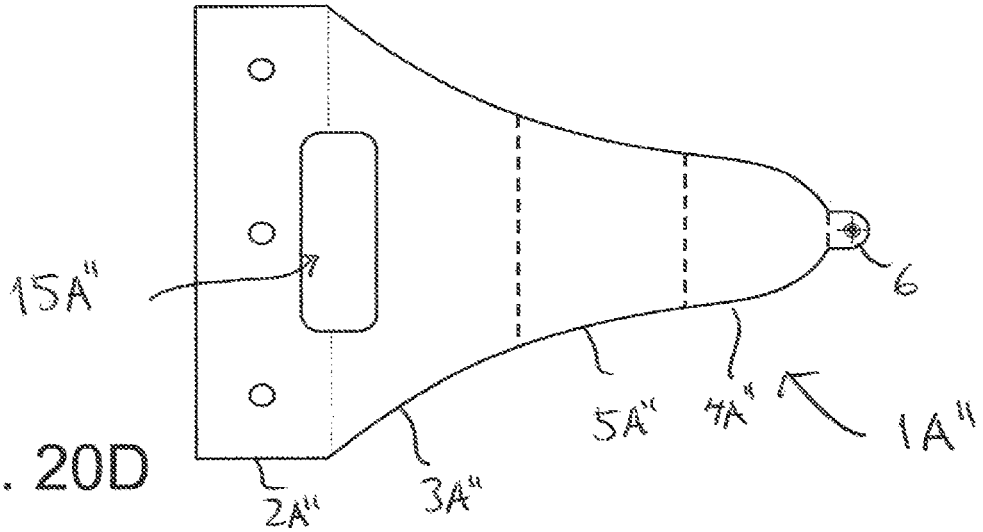
FIG. 20D is a top view of an alternative antenna petal element with a slot before being folded or bent.

FIG. 20D shows an antenna petal 1A" with a slot 15A" provided in the first wall portion 3A", and optionally also partly in the first connecting portion 2A". The slot 15A" is closed, and substantially of a rectangular shape in parallel with the longitudinal extension of the first connecting portion 2A". For the other elements similar reference numerals are used as in FIG. 1, but referenced with a double prime sign.

Figure 20E:
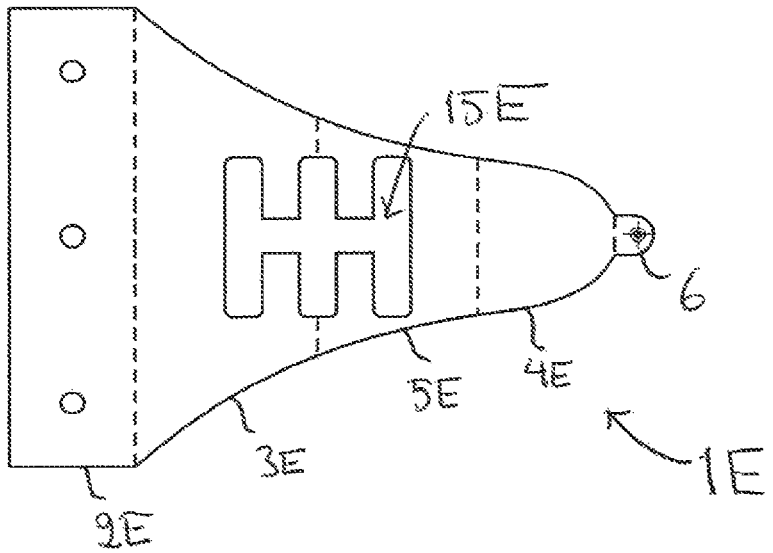
FIG. 20E is a top view of another alternative antenna petal element with a slot before being folded or bent.

FIG. 20E shows an antenna petal 1E with an inner centre slot 15E provided in the first wall portion 3E, and also in the intermediate mounting portion 5E. The slot 15E is closed, centrally located and is tooth- or comb-shaped. For the other elements similar reference numerals are used as in FIG. 1, but indexed with an E.

Figure 20F:
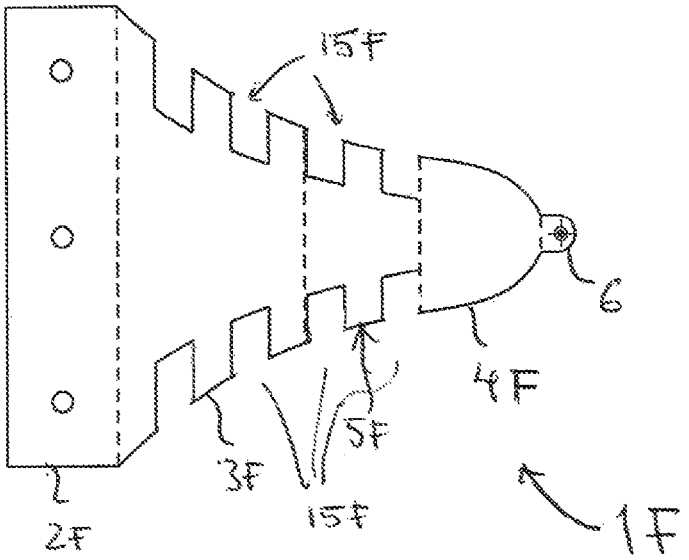
FIG. 20F is a top view of still another alternative antenna petal element with edge slots or cut-outs before being folded or bent.

FIG. 20F shows an antenna petal 1F with external edge slots 15F,15F provided e.g. along at least part of the outer sides of the first wall portion 3F, the intermediate mounting portion 5F and the second wall portion 4F. The slots 15F,15F are tooth- or comb-shaped. For the other elements similar reference numerals are used as in FIG. 1, but indexed with an F.

Figure 20G:
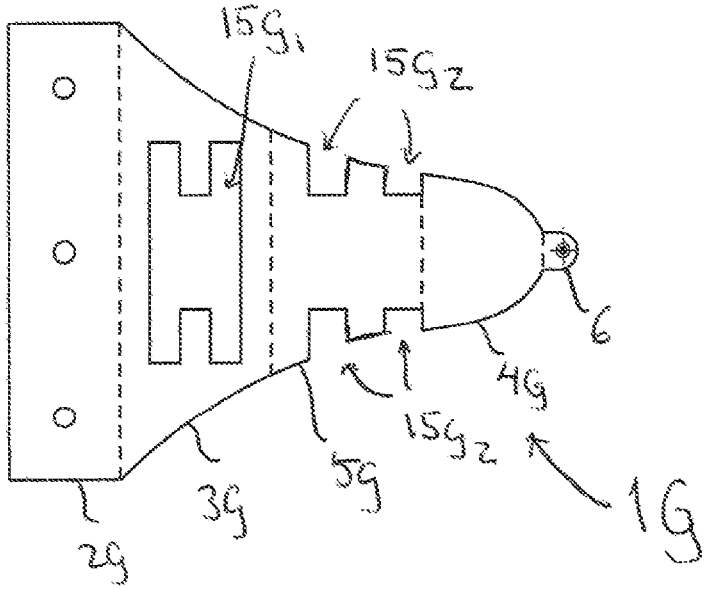
FIG. 20G is a top view of still another alternative antenna petal element comprising an internal slot and edge slots before being folded or bent.

FIG. 20G shows an antenna petal 1G with external edge slots 15$G_2$, 15$G_2$ provided e.g. along at least part of the outer sides of the second wall portion 4G, and an inner, closed, tooth-shaped centre slot 15$G_1$ provided in the first wall portion 3G, and the intermediate mounting portion 5G. For the other elements similar reference numerals are used as in FIG. 1, but indexed with a G.

In some embodiments the periodic distance between antenna petals in an array (between center points thereof) is about 0.5λ, but it may also assume other values, e.g. it may be larger. The height above the ground plane may be between 0.2 and 0.5λ, but of course these values are also merely given for exemplifying reasons. In some embodiments the relative bandwidth is at least 1.6.

It should be clear that different antenna petals and different arrangements, geometries and numbers of petals can be used and combined to provide different bowtie structures in any desired manner, and also be combined with thin dielectric sections or thick dielectric plugs to provide for different desired properties, depending on intended applications and used frequencies. In some embodiments petals with slots are only used along the outer edges of e.g. an array of bowtie structures.

It should also be clear that any connectors, e.g. coaxial connectors, may be provided for and arranged in any desired manner. The ports may comprise coaxial connectors with centre conductors that connect microstrip transmission lines and/or baluns to respective conducting elements 12, said microstrip lines and/or baluns being arranged on the front or back side of the conducting ground plane or the PCB.

Through the use of appropriate electronics, antenna arrays with controllable lobes are provided which are useable for several, in particular high frequency applications, e.g. in Massive MIMO base stations.

The antenna petals may also have other shapes than explicitly shown in the exemplifying embodiments. They may e.g. have a shape tapering towards the end tips in a symmetric or in a non-symmetric manner, starting with a rapidly tapering region after which the respective arm section is narrow and then taper regularly towards the end tip portion. It should be clear that the shape of the antenna petals can be chosen and optimized in different ways; only a few advantageous embodiments are shown. The two side edges of an arm section may e.g. taper symmetrically but irregularly, being straight or curved or a combination of both. The petals may also have more slots in them than the ones marked as 15, and also in other portions of the petals.

Preferably the petal is made in one piece, which is cut or punched out of a piece of metal, with or without one or more slots, wall etc., and then folded, bent or pressed into the desired shape, or alternatively pressed or folded and punched or cut in one step. The petals are then e.g. soldered onto the conducting ground plane or the PCB. The first connecting end 2 may also or alternatively have mounting holes for fixing it to the ground plane by using screws or pop rivets.

The antenna elements may be made of a conductive material comprising metal, e.g. Cu, Al, or a material with similar properties, or an alloy.

Different mounting elements (not shown) can be provided for in any appropriate manner in order to allow for easy and reliable mounting of the antenna arrangement wherever desired, for example on the top of a mast, on a wall, at a micro base station etc.

It should be clear that the widths and shapes of conductors may be different, where the conductors are located may differ, and the types and arrangement of conducting wires and pins, as well as the arrangement of holes in the metal surface on the central portion of the PCB may be differently implemented. Also the shape of the dielectric central portion, although preferably being circular, square shaped or rectangular, may be different and may also have any other shape, for example triangular or hexagonal etc. The antenna arrangements may in some applications be used for wall mounting as a wall antenna with approximately a hemispherical coverage.

Embodiments of an antenna arrangement comprising but one single antenna petal are also covered by the inventive concept. The end tip portion of the petal is then in a similar manner via e.g. a conducting pin connected to, for example a microstrip line, e.g. on the back side of the central portion. A coaxial connector may be provided at an outer edge located distant from the end tip portion or elsewhere at any other appropriate location. It should be clear that other conductor types can be used, as well as other types of connectors.

An antenna arrangement may comprise a non-directional antenna arrangement comprising a number of antenna structures mounted on the PCB or conducting ground plane with, in e.g. a central portion, comprising separate, or for some petals, common, openings for the conducting elements.

The inventive concept also covers antenna arrangements comprising e.g. three or any other odd number of antenna petals, wherein the petals are so disposed that the end tip portions end at a slight distance from each other. Conducting pins connect the end tip portions via openings with conductors or coaxial connectors (not shown) e.g. located on the back side of the PCB or the conducting ground plane.

With a three port bowtie antenna (i.e. an arrangement with three petals), a particularly low coupling between ports can be achieved. Thus, with three petals a particularly compact antenna with a low or substantially no coupling between ports can be provided, e.g. suitable for wall mounting.

It should be clear that the antenna arrangements as described also may be provided as double sided arrangements, i.e. with such antenna arrangements arranged back-to-back e.g. for mounting on a mast or similar, hence providing for spherical coverage instead of a hemispherical coverage.

In one implementation an antenna arrangement comprising a plurality of antenna petals, via mounting element, may be mounted on the top of a mast. Connectors may e.g. be arranged on the edges of the conducting ground plane or the PCB in order to be easily accessible.

It is a particular advantage of the invention that antennas with multiple ports are provided which are suitable for MIMO systems, particularly Massive MIMO systems, and which are highly uncoupled (such that variations on channels will be different, avoiding that all channels have a low level at the same time).

It is a particularly an advantage that a MIMO antenna, particularly an antenna that can be used as an element in a Massive MIMO array for 5G, which additionally is very small and compact and can be made in a very cheap, easy and automated manner and that the antenna petals very easily can be mounted in a fast manner. Moreover it is a most particular advantage that a bowtie antenna arrangement is provided which has a very high bandwidth, e.g. up to octave bandwidth or even more.

In some embodiments it may have dimensions smaller than one third of the lowest operating frequency. It is also an advantage that an antenna arrangement is provided which has a low correlation between different antenna ports when it is used in a statistical field environment with multipath, e.g. as low as 0.1 over 0.4-16 GHz in an arrangement with four antenna elements although they are located very close to one another. Such a low correlation can be assured by designing the multi-port antenna for having low mutual coupling measured between its ports (i.e. S-parameters $S_{mn}$, scattering parameters, smaller than typically −10 dB). It is also an advantage that a large angular coverage can be provided, by all ports together, for example 360° for some implementations, or that antenna elements easily and flexibly can be arranged so as to together provide a desired angular coverage when the received voltages on all ports are combined digitally by a so called MIMO algorithm. An example of such an algorithm is Maximum Ratio Combining (MRC).

In one application it may comprise a linear array used to feed a parabolic cylinder that e.g. can be used in an OTA (Over-The-Air) test system for wireless communication to vehicles. Then, the linear array in combination with the cylindrical parabolic reflector create a plane wave illuminating the vehicle, e.g. a car.

The invention is not limited to the illustrated embodiments, but can be varied in a number of ways within the scope of the appended claims.

The invention claimed is:

1. A self-grounded antenna arrangement, comprising:

a base portion comprising a conducting ground plane or printed circuit board ("PCB") configured to work as a conducting ground plane;

an antenna structure having a number of antenna petals, each antenna petal having at least one arm section tapering toward a respective end tip portion at one end and at least one planar first connecting portion at an opposite end, and being made of an electrically conducting material;

wherein the end tip portions are arranged to approach a first side of the base portion and are configured for connection to feeding ports;

wherein a separate port is provided for each antenna petal comprising an arm section, the end tip portions being isolated from said conducting ground plane;

wherein the antenna structure comprises at least one pair of said antenna petals forming a bowtie;

wherein each antenna petal functions as curved monopole and loop antennas;

wherein each antenna petal is made in one piece from a conductive sheet;

wherein each antenna petal is surface-mounted on said first side of the base portion, said first side being either a front side or back side of the base portion; and wherein the planar first connecting portion(s) are connected to said conducting ground plane.

2. The self-grounded antenna arrangement of claim 1, wherein the, or each, antenna petal comprises a planar first connecting portion for connecting to a front side of the conducting ground plane or PCB, a first wall portion that forms an angle with a plane in which the first connecting portion extends, an intermediate mounting portion having a flat portion and arranged to interconnect the first wall portion, and a second wall portion in an opposite end connecting to or turning into a second connecting end tip portion disposed in the same plane as the first connecting portion.

3. The self-grounded antenna arrangement of claim 1, wherein the end tip portion of each antenna petal comprises a flat rounded portion.

4. The self-grounded antenna arrangement of claim 1, wherein the end tip portion of each antenna petal comprises an opening configured for a conducting pin or wire that is electrically connected to the end tip portion for feeding the respective antenna petal.

5. The self-grounded antenna arrangement of claim 2, wherein the first connecting portions of antenna petals are soldered or fixed by screws or pop rivets onto the metal ground plane or PCB.

6. The self-grounded antenna arrangement of claim 1, wherein at least one antenna petal comprises a slot in the first wall portion.

7. The self-grounded antenna arrangement of claim 1, wherein at least one antenna petal comprises a groove formed by the first wall portion and an additional wall portion connecting to the first connecting portion at a side opposite a side where the first wall portion is located and extending substantially in parallel with the first wall portion, the additional wall portion having a length configured to a length of the first wall portion or to a length of an outer side of the conducting ground plane or PCB.

8. The self-grounded antenna arrangement of claim 6, wherein at least one antenna petal comprises at least one slot and a groove formed by the first wall portion and an additional wall portion.

9. The self-grounded antenna arrangement of claim 1, wherein the conducting ground plane or the PCB comprises either a dielectric portion or a hole under each respective second connecting end tip portion to isolate each respective second connecting end tip portion from the conducting ground plane.

10. The self-grounded antenna arrangement of claim 9, wherein at least one dielectric portion comprises a dielectric film.

11. The self-grounded antenna arrangement of claim 1, wherein at least two antenna petals form antenna structures comprising one or more bowties, and antenna ports of antenna petals of a bowtie are configured to be independently excited.

12. The self-grounded antenna arrangement of claim 1, wherein at least two antenna petals form antenna structures comprising one or more bowties, and antenna ports of antenna petals of a bowtie are connected to and combined by a respective balun, each balun comprising a 180 degrees hybrid located either on a side of the conducting ground plane or PCB on which the antenna petals are located or on the other side of the conducting ground plane or PCB.

13. The self-grounded antenna arrangement of claim 12, wherein at least one antenna structure comprises two antenna petals that form a bowtie having two ports that are differentially excited.

14. The self-grounded antenna arrangement of claim 12, wherein at least one antenna structure comprises four antenna petals that form a bowtie having four ports.

15. The self-grounded antenna arrangement of claim 12, wherein at least one antenna structure comprises a number of antenna petals that form a number, N, of bowties, each comprising four ports; and the N bowties are arranged in a linear array.

16. The self-grounded antenna arrangement of claim 1, wherein at least one antenna structure comprises a number of antenna petals that form a number, N, of bowties, each comprising four ports; and the N bowties are arranged in a planar array.

17. The self-grounded antenna arrangement of claim 16, comprising at least two antenna petals that form one or more bowties, and ports for each antenna petal are substantially uncoupled such that their far field functions are substantially orthogonal in either polarization, direction, or shape.

18. The self-grounded antenna arrangement of claim 1, wherein the antenna arrangement is an ultra-wideband antenna arrangement for a wireless communication system with a computationally determined radiation pattern selectively determined for horizontal and vertical planes.

19. The self-grounded antenna arrangement of claim 1, wherein at least two antenna structures are adjacently arranged substantially in a same plane or along a surface, and the at least two antenna structures are arranged with respect to each other such that their ports are arranged proximate outer side edges of the conducting ground planes or PCBs or on front or back sides.

20. The self-grounded antenna arrangement of claim 1, wherein each antenna petal comprises a planar first connecting portion for connecting to a first side of the conducting ground plane or PCB, a first wall portion that forms a first angle with a plane in which the first connecting portion extends, an intermediate mounting portion having a flat portion and connected to or turning into the first wall portion, and a second wall portion in an opposite end connecting to or turning into a second connecting end tip portion disposed in the same plane as the first connecting portion, wherein the second wall portion forms a second angle with the plane in which the first connecting portion extends, said second angle being smaller than the first angle, such that the second wall is disposed in a more slanting, less steep manner in respect to said plane, the second wall portion comprising said at least one arm section tapering toward the second connecting end tip portion.

21. An antenna petal for a self-grounded antenna arrangement, comprising:

an arm section tapering toward an end tip portion at one end and at least one planar first connecting portion at an opposite end, and being made of an electrically conducting material, the end tip portion being configured for connection to a feeding port;

wherein the antenna petal forms a half-bowtie antenna element;

wherein the antenna petal is made in one piece from a conductive sheet and is configured to be surface-mounted on a front or back side of a base portion;

the base portion comprises either a conducting ground plane or a printed circuit board (PCB) working as a conducting ground panel; and wherein the planar first connecting portion(s) is connected to said conducting ground plane.

22. The antenna petal of claim 21, comprising a planar first connecting portion configured for connection to a front side of the conducting ground plane or PCB, a first wall portion forming an angle with a plane in which the first connecting portion extends, an intermediate mounting portion arranged to interconnect the first wall portion with a second wall portion in an opposite end connecting to or turning into a second connecting end tip portion disposed in the same plane as the first connecting portion and configured for connection to the base portion.

23. The antenna petal of claim 21, wherein the first wall portion includes a slot; the petal further comprises a groove formed by the first wall portion and an additional wall portion connecting to the first connecting portion at a side opposite to a side where the first wall portion is located and extending substantially in parallel with the first wall portion; the additional wall portion has a length configured to a length of the first wall portion or a length of an outer side of the conducting ground plane or PCB.

24. A method of fabricating a self-grounded antenna arrangement having at least one antenna petal comprising an electrically conducting arm section tapering toward an end tip portion at one end, and at least one planar first connecting portion at an opposite end, the method comprising:

punching or pressing the at least one antenna petal in one piece from a sheet of metal, wherein each antenna petal forms a half-bowtie antenna element;

surface-mounting the at least one antenna petal in a desired antenna petal structure on a base portion, the base portion comprising a conducting ground plane or printed circuit board (PCB) working as a conducting ground plane, whereby the first connecting portion(s) is connected to said conducting ground plane; and electrically connecting end tip portions of antenna petals via conducting wires or pins to an antenna feed.

25. The method of claim 24, further comprising:

punching and pressing each antenna petal into a shape, comprising a first, at least partially planar, connecting portion, configured for connection to the front side of the metal ground plane or the PCB, a first wall portion forming an angle with the plane in which the first connecting portion extends, an intermediate mounting portion, which preferably is flat or comprises a flat portion, and is arranged to interconnect said first wall portion with a second wall portion in an opposite end connecting to, or turning into a second connecting end tip portion disposed in the same plane as the first connecting portion and also being configured for connection to the base portion.

* * * * *